United States Patent [19]

Ishida et al.

[11] Patent Number: 5,009,145

[45] Date of Patent: Apr. 23, 1991

[54] AUTOMATIC PERFORMANCE APPARATUS HAVING AUTOMATIC SYNCHRONIZING FUNCTION

[75] Inventors: Takashi Ishida; Masao Kondo, both of Hamamatsu, Japan

[73] Assignee: Yamaha Corporation, Hamamatsu, Japan

[21] Appl. No.: 321,228

[22] Filed: Mar. 8, 1989

[30] Foreign Application Priority Data

Mar. 8, 1988 [JP] Japan ..... 63-54556

[51] Int. Cl.[5] ..... G10H 1/38; G10H 1/40; G10H 7/00

[52] U.S. Cl. ..... 84/612; 84/613; 84/DIG. 12; 84/DIG. 22

[58] Field of Search ..... 84/609-614, 84/634-642, DIG. 12, DIG. 22, DIG. 29

[56] References Cited

U.S. PATENT DOCUMENTS 4,704,933 11/1987 Kurakake ..... 84/612
4,957,031 9/1990 Kondo et al. .

FOREIGN PATENT DOCUMENTS 59-197095 11/1984 Japan .

*Primary Examiner*—Stanley J. Witkowski
*Attorney, Agent, or Firm*—Spensley Horn Jubas & Lubitz

[57] ABSTRACT

An automatic performance apparatus provides a memory capable of storing plural parts of a desirable tune, wherein each part can be independently recorded or reproduced, regardless of recording or reproduction of another part. While performance information of one part is recorded or reproduced after a first detector detects the designation of recording or reproducing of one part so that an automatic performance of one part is played, the automatic performance apparatus can reproduce another performance information of another part after a second detector detects a section end of one part so that another automatic performance of another part is played. This another part is started to be automatically performed at the timing synchronizing with a progress of recording or reproducing the performance information of one part. Thus, the synchronization between one part and another part can be automatically obtained without effort.

5 Claims, 19 Drawing Sheets

(CONFIGURATION OF ELECTRONIC MUSICAL INSTRUMENT)

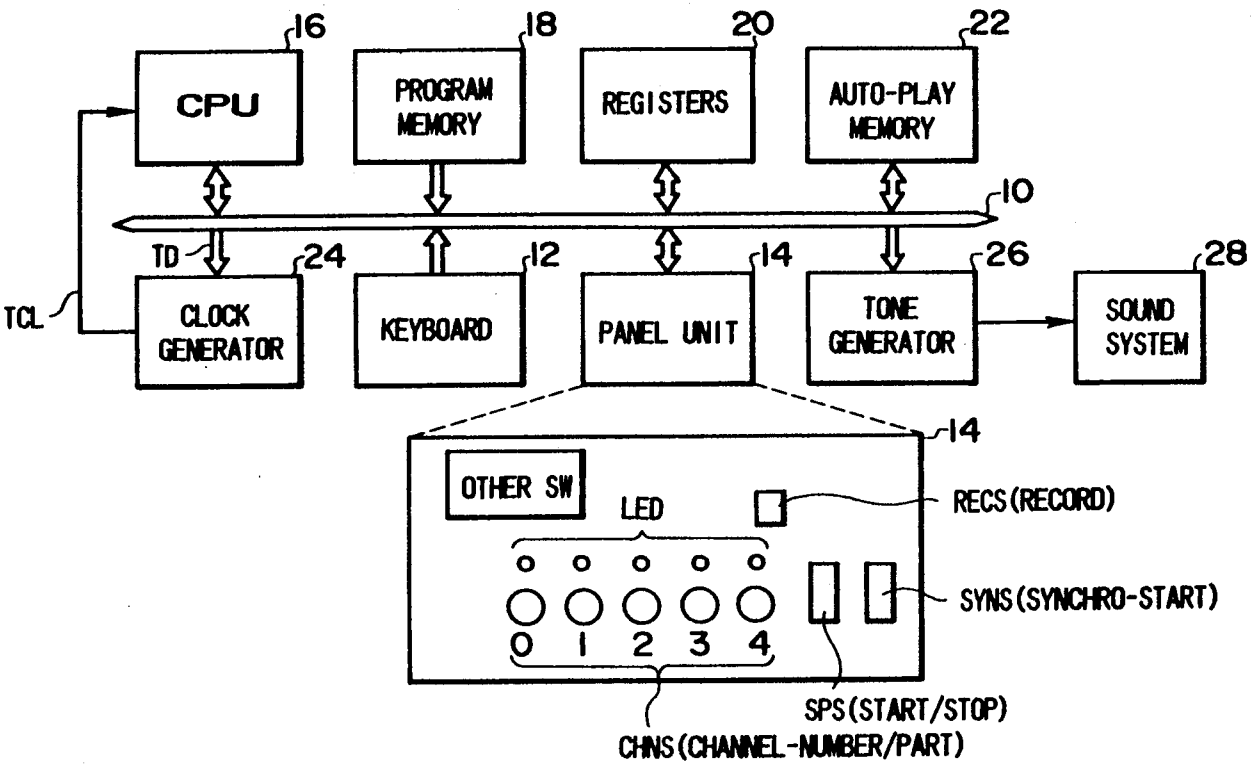
FIG. 1 (CONFIGURATION OF ELECTRONIC MUSICAL INSTRUMENT)
| TONE NAME | $C_1$ --- $C_2$ $C_2^*$ --- $B_2$ $C_3$ --- $C_4$ --- $C_5$ |
|---|---|
| KEY CODE | 36 --- 48 49 --- 59 60 --- 72 --- 84 |
FIG. 2 (KEY CODE OF EACH TONE NAME)

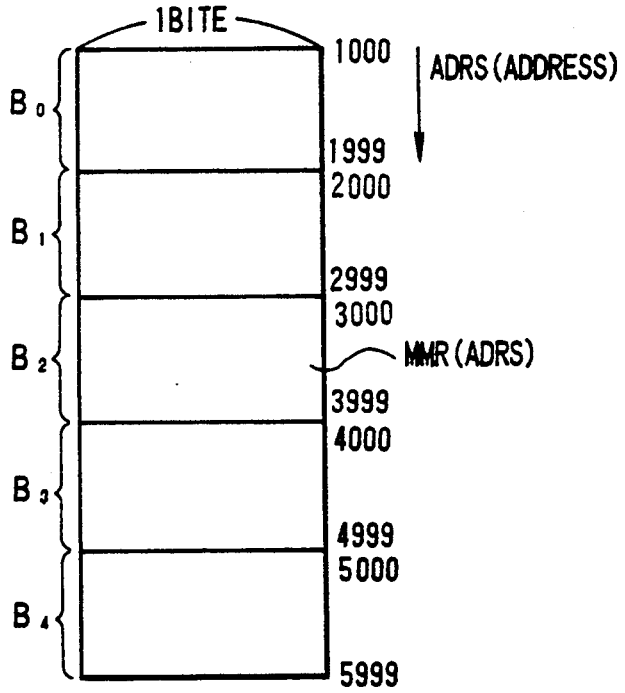
FIG. 3 (CONFIGURATION OF MEMORY 22)
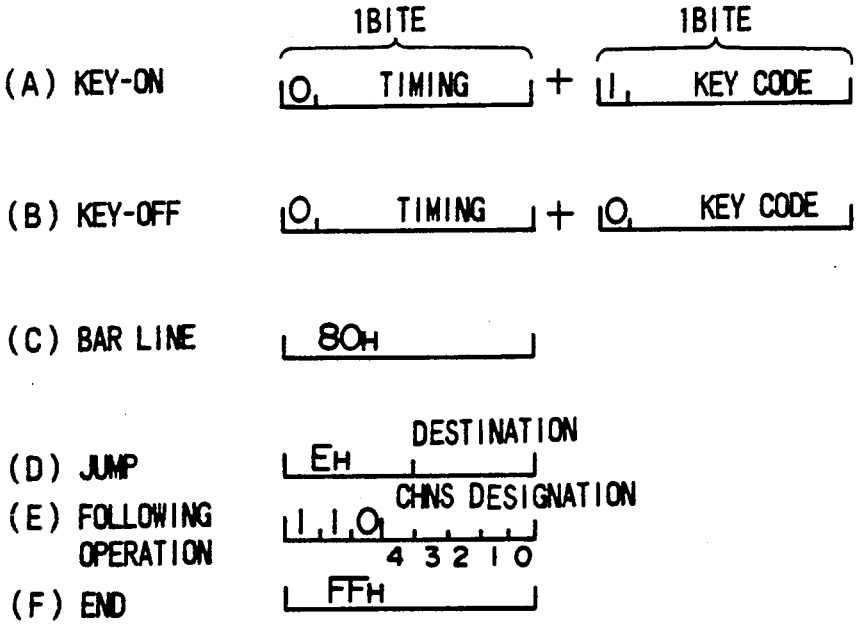
FIG. 4 (DATA FORMAT OF MEMORY22)

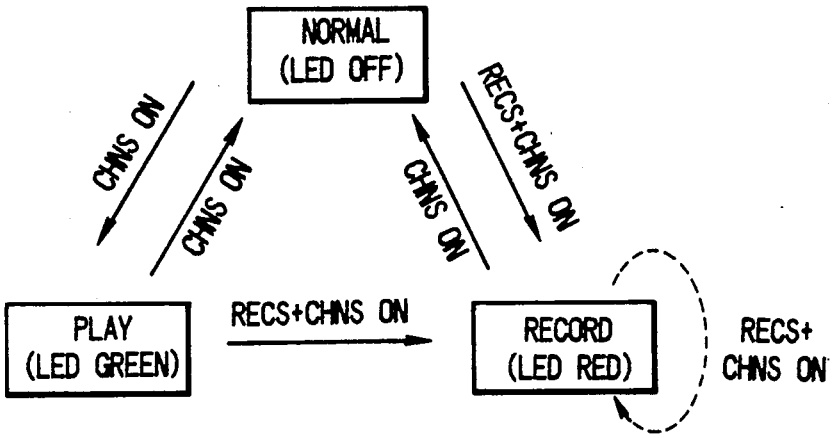
FIG. 5 (MODE CHANGE-OVER OPERATION)
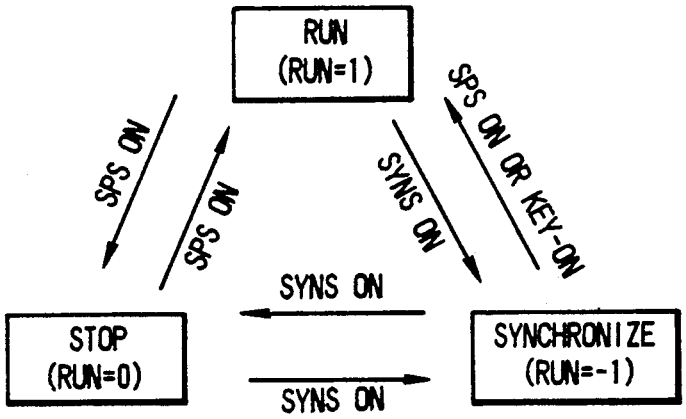
FIG. 6 (START/STOP OPERATION)

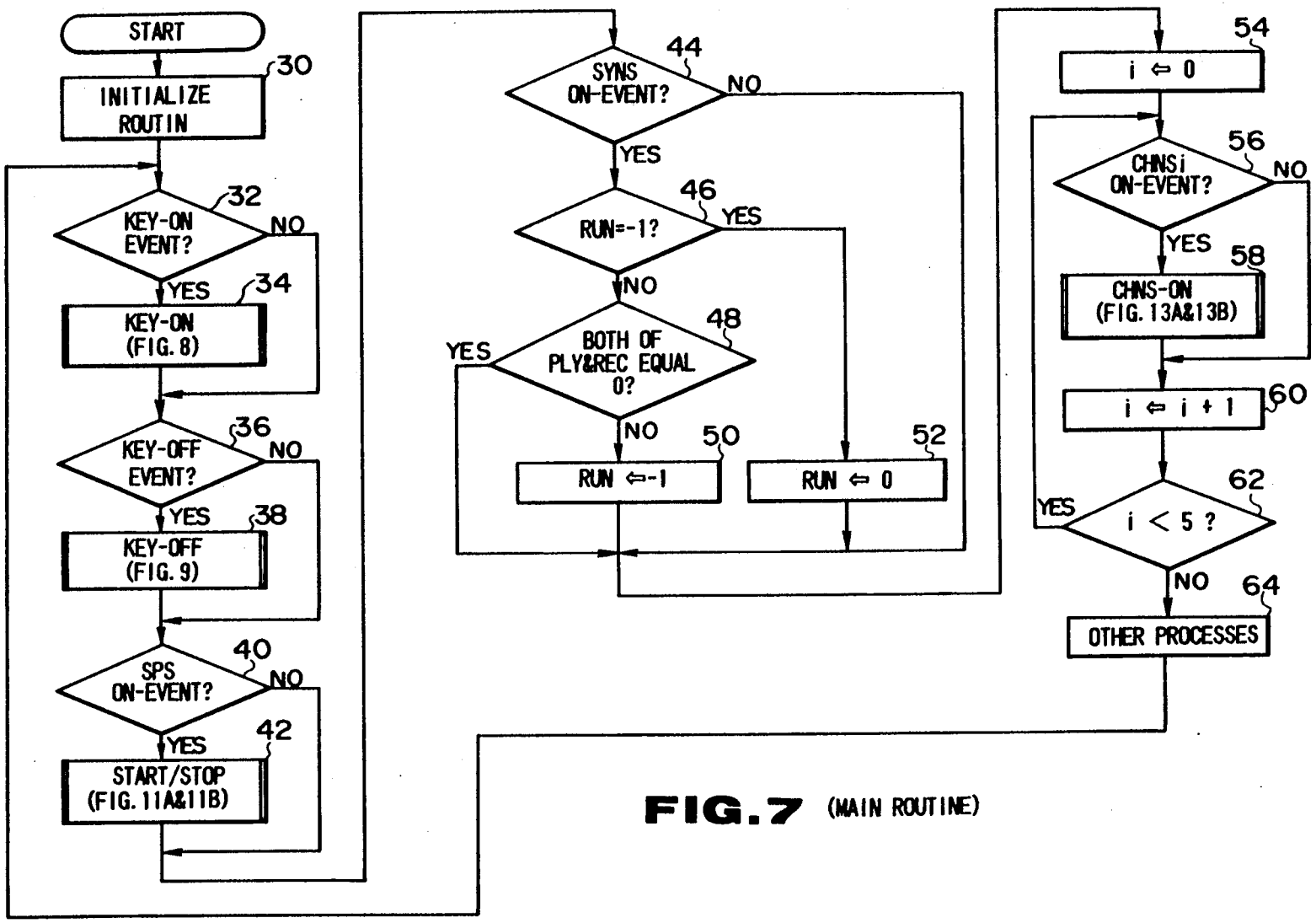
FIG. 7 (MAIN ROUTINE)

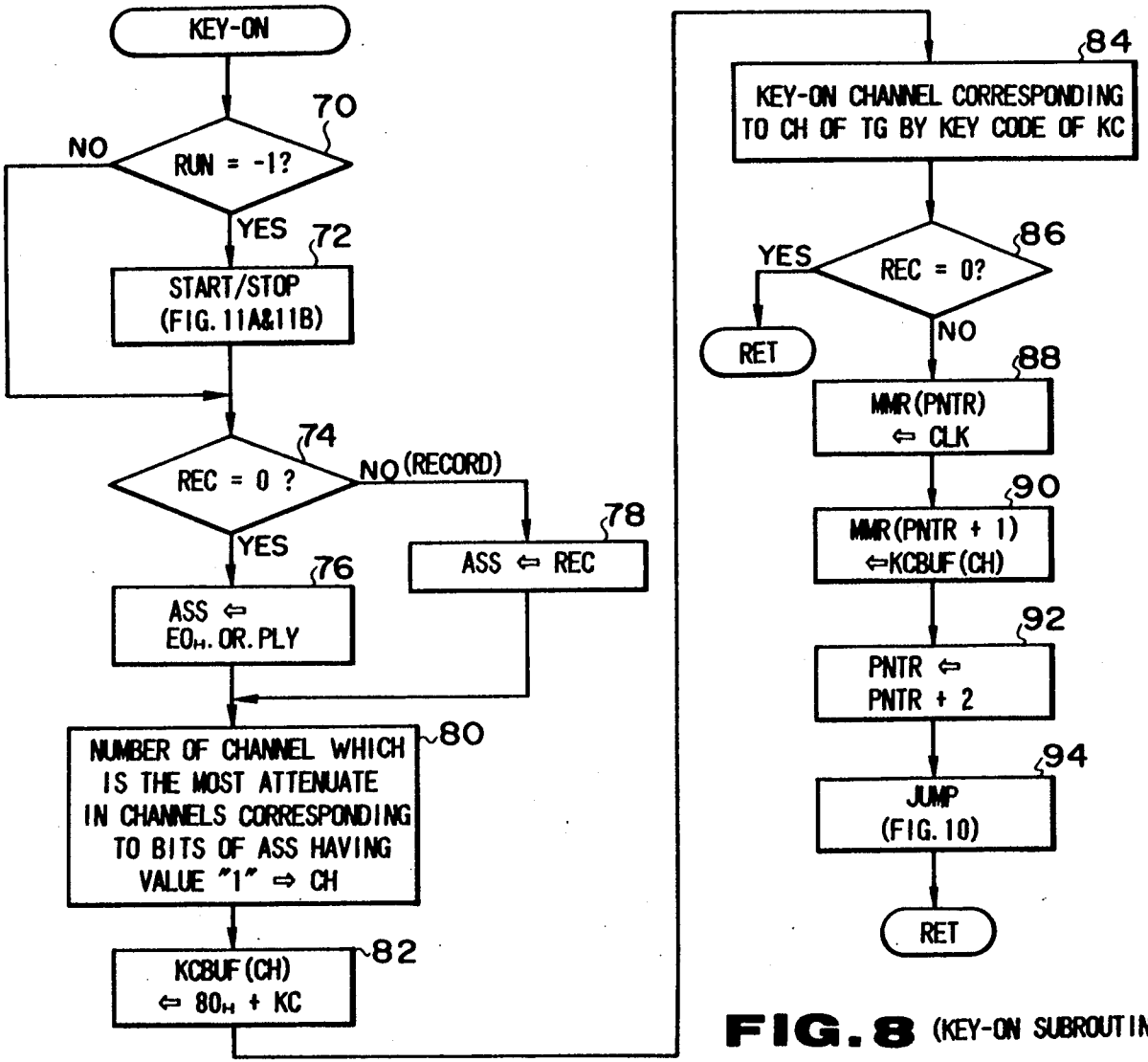
FIG. 8 (KEY-ON SUBROUTINE)

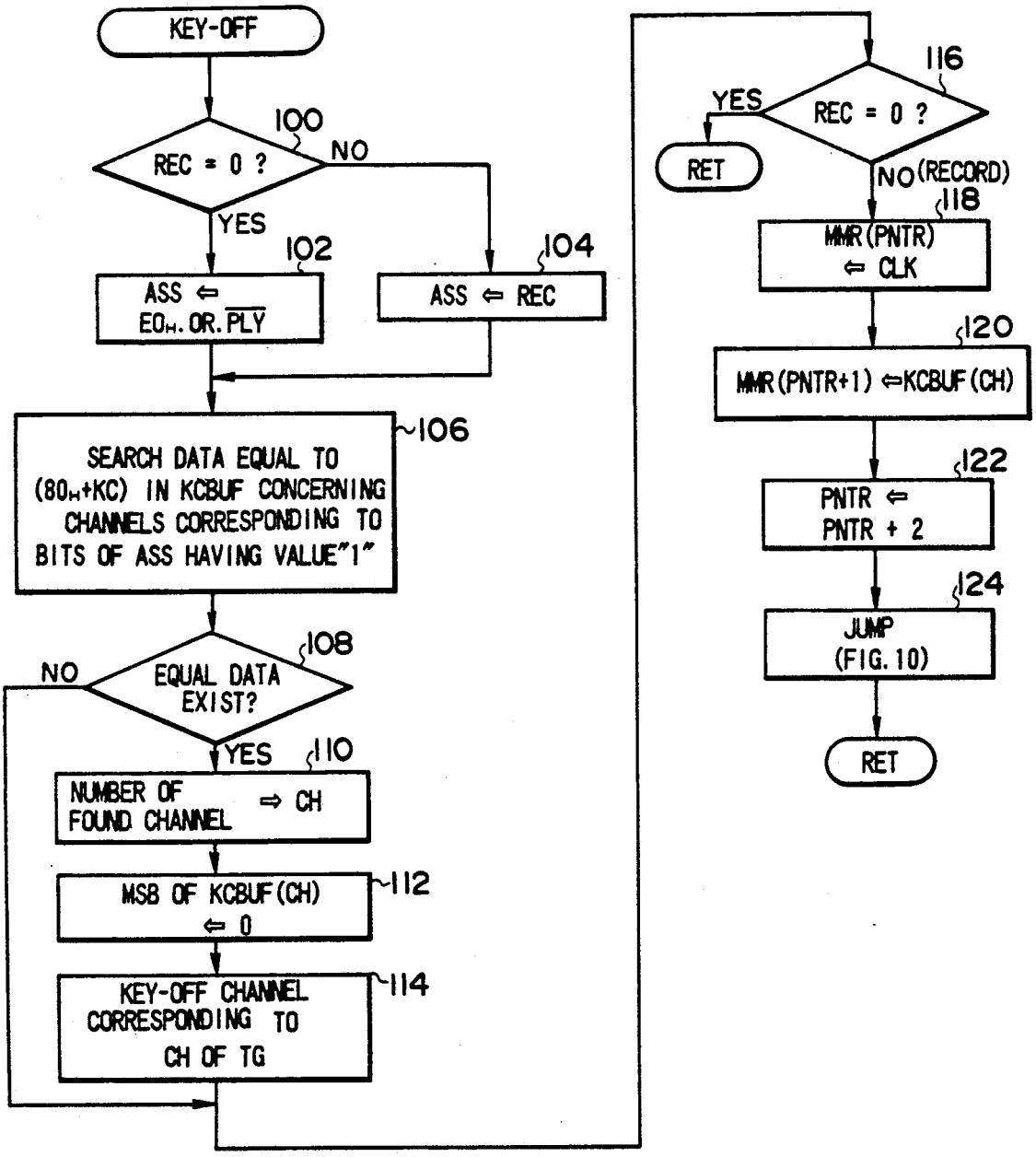
FIG. 9 (KEY-OFF SUBROUTINE)

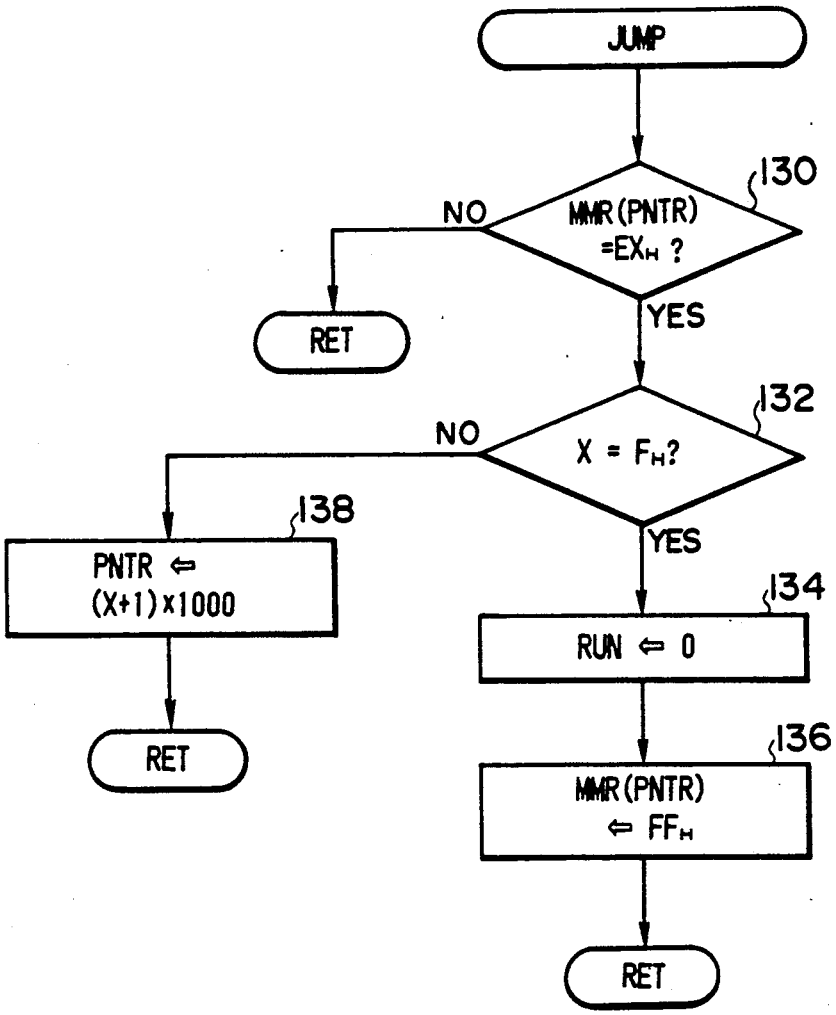
FIG.10 (JUMP SUBROUTINE)

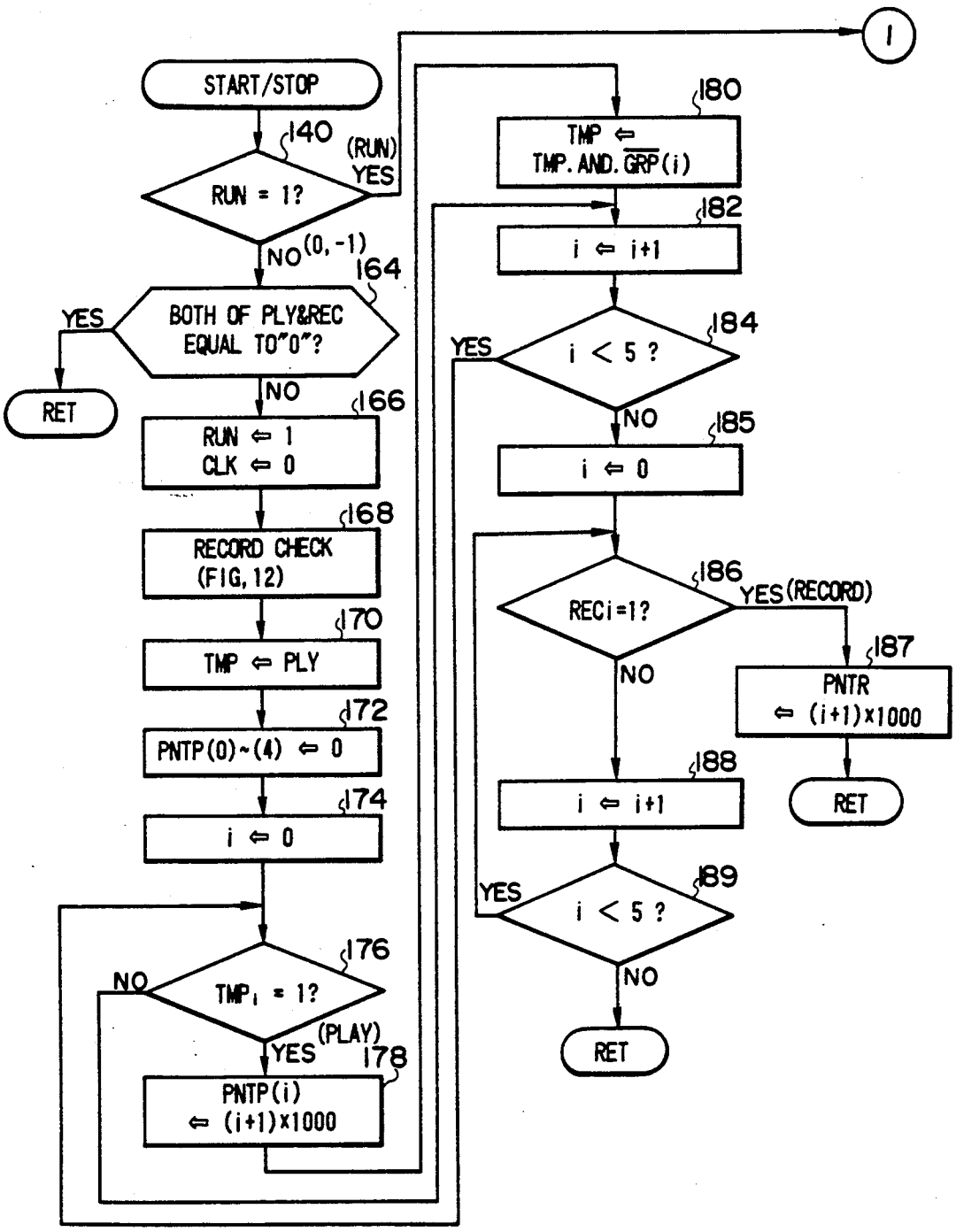
FIG.11A (START/STOP SUBROUTINE)

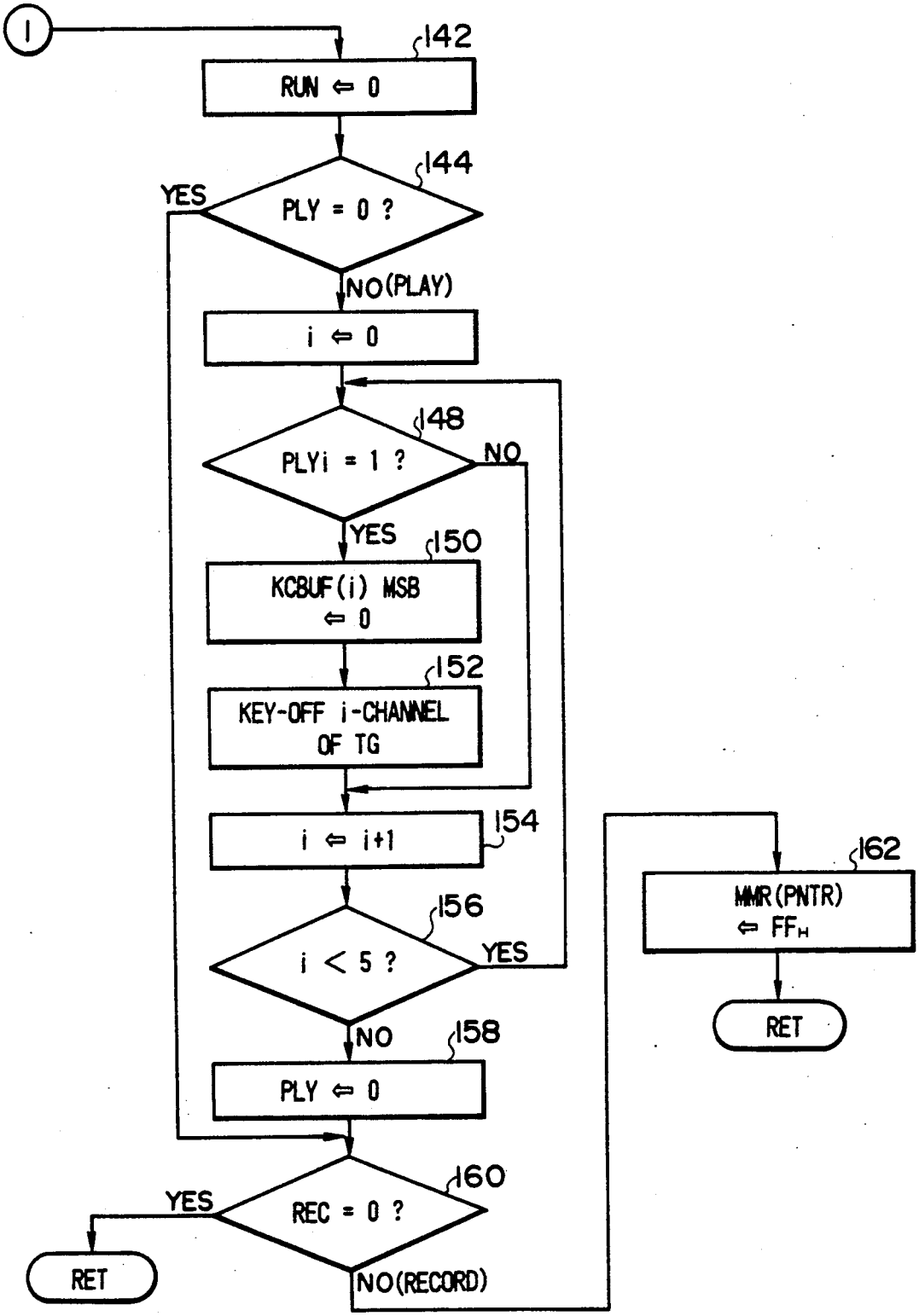
FIG.11B (START/STOP SUBROUTINE)

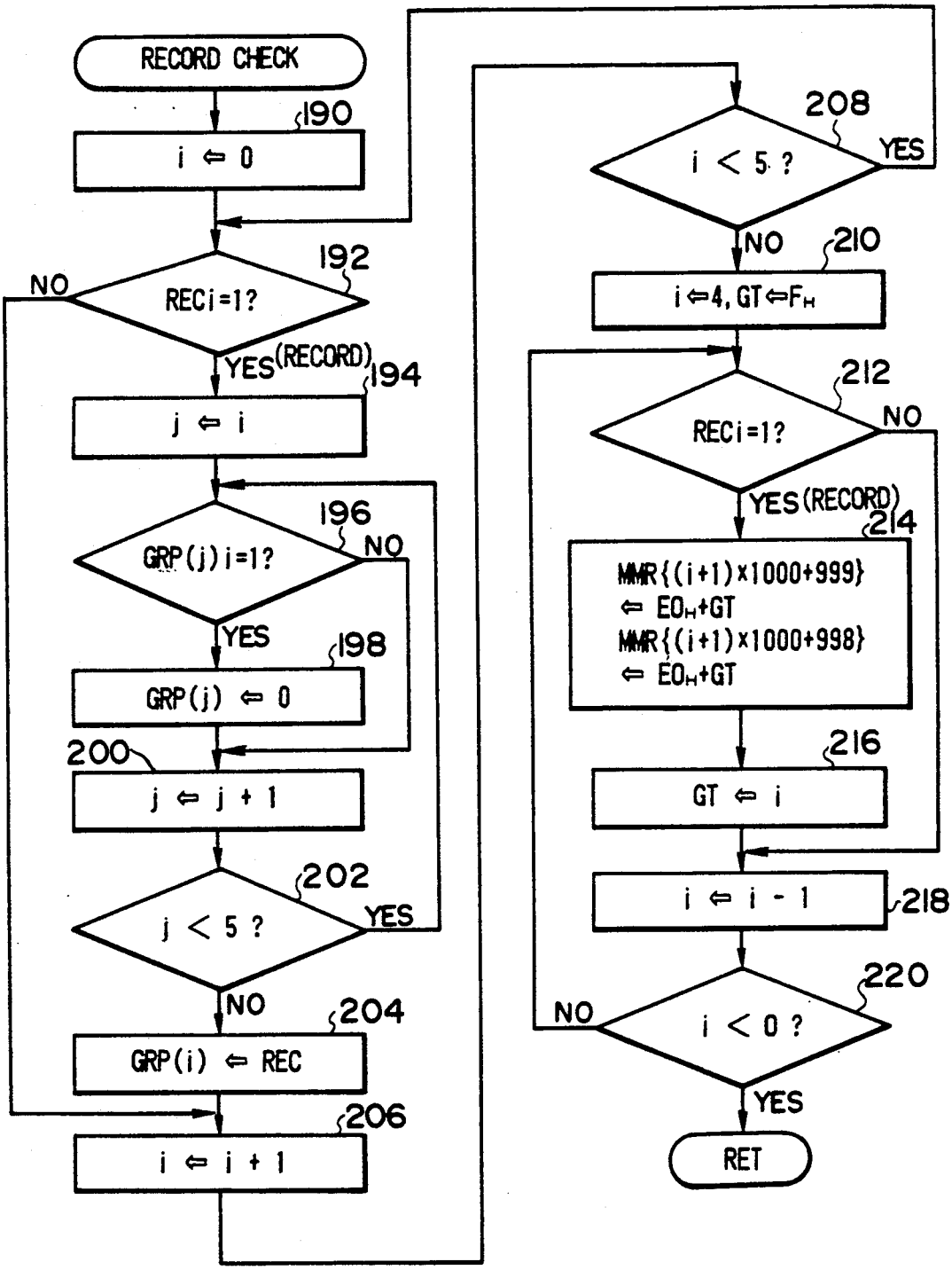
FIG.12 (RECORD CHECK SUBROUTINE)

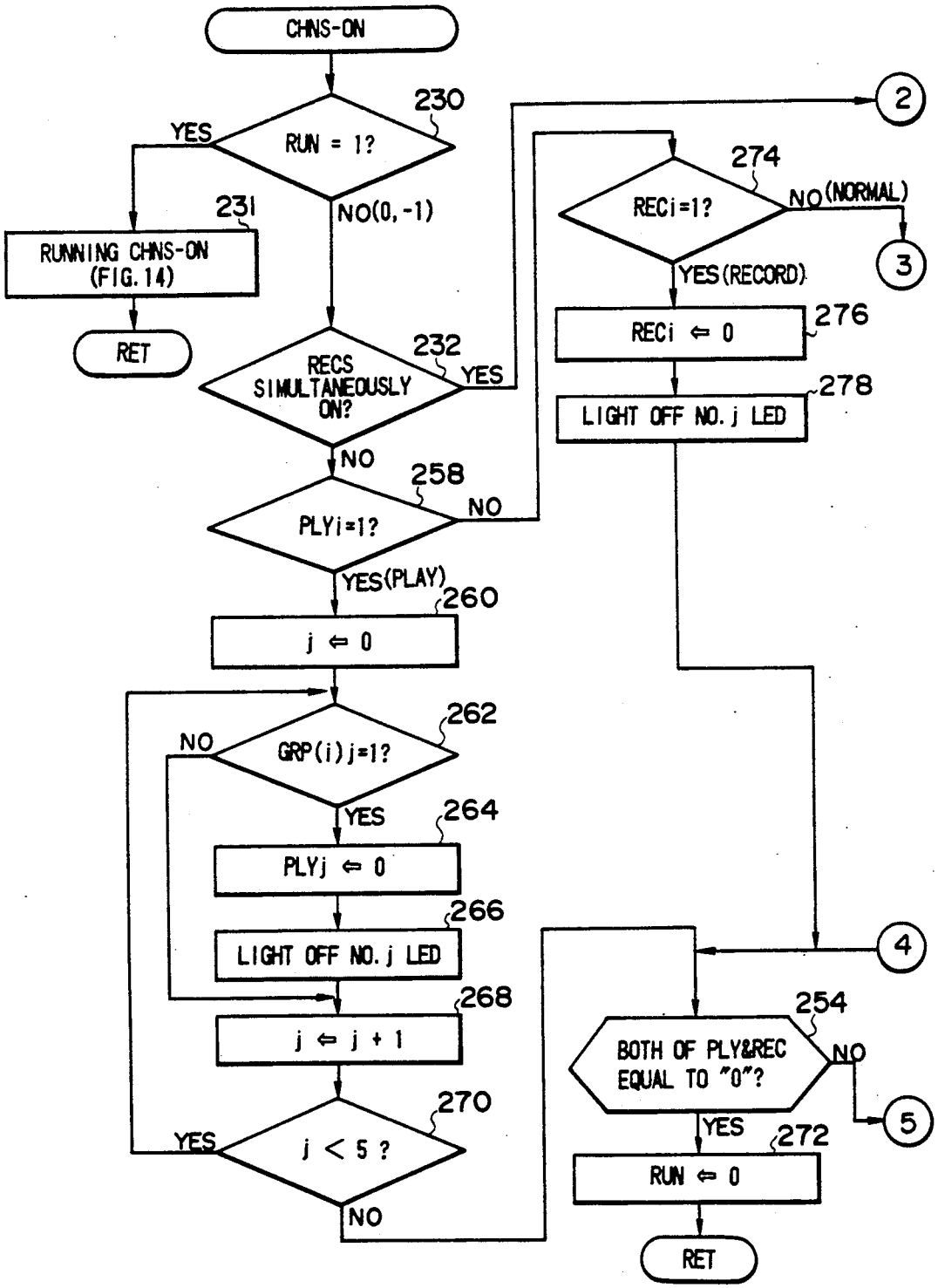
FIG.13A (CHNS-ON SUBROUTINE)

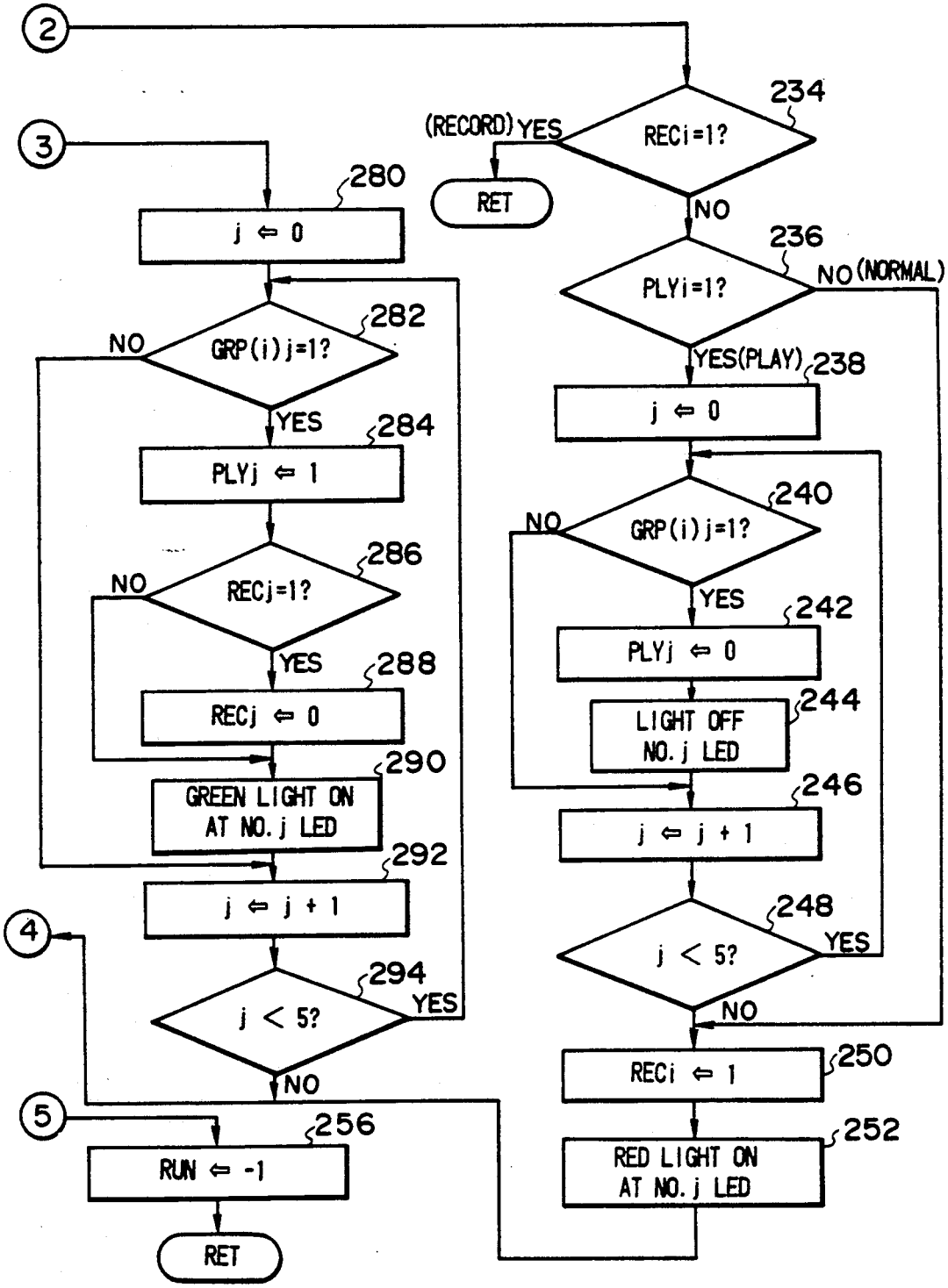
FIG.13B (CHNS-ON SUBROUTINE)

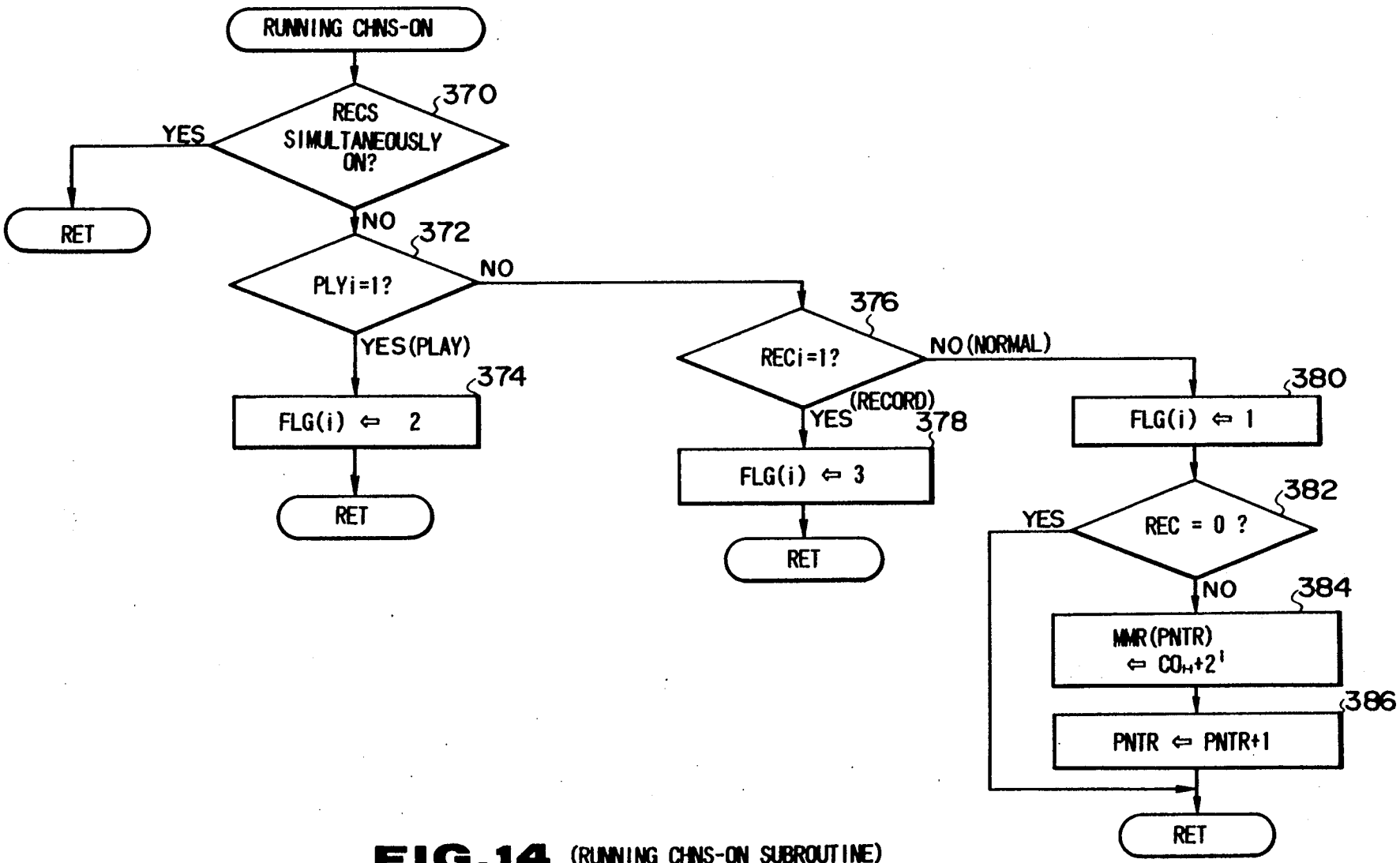
FIG. 14 (RUNNING CHNS-ON SUBROUTINE)

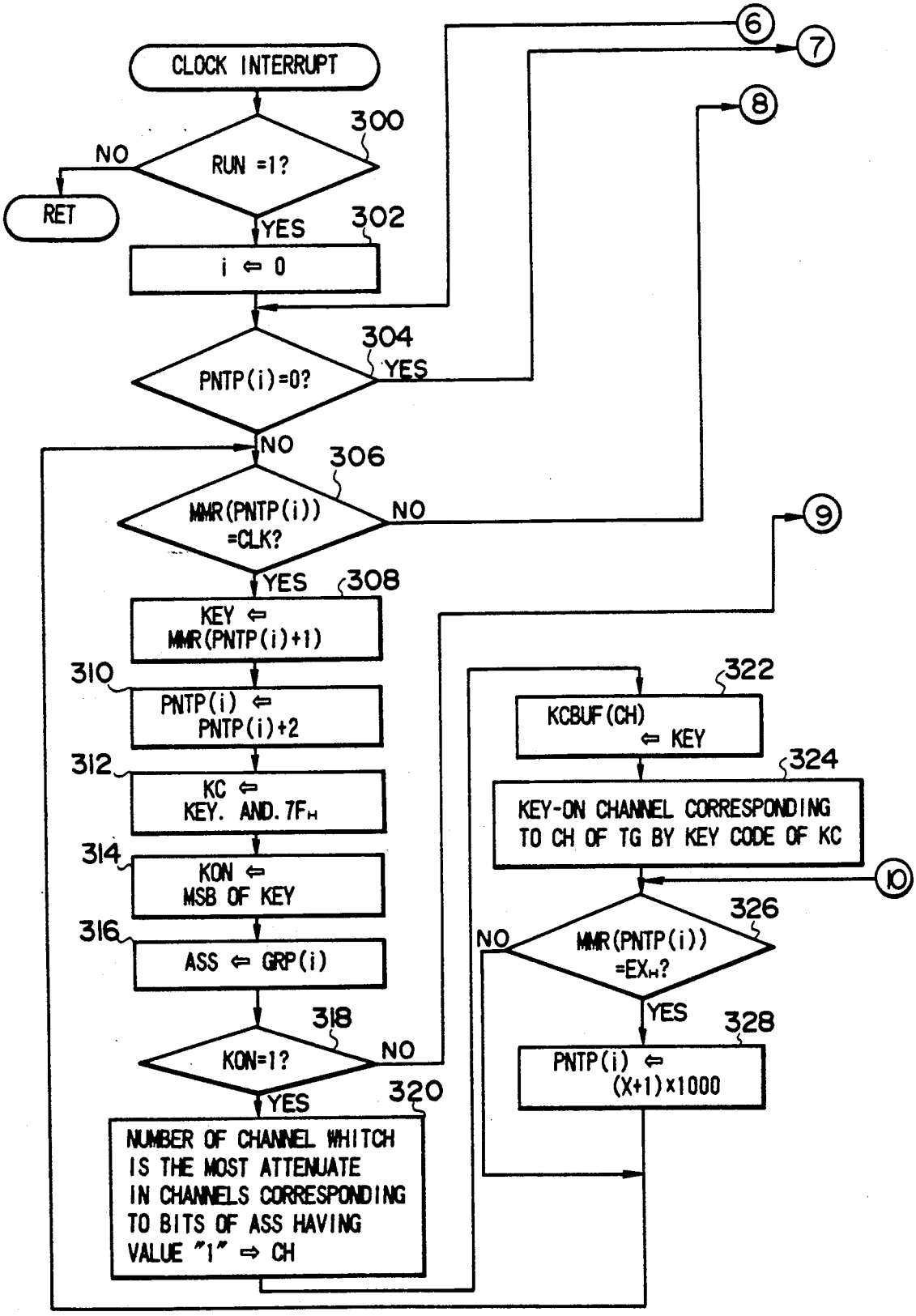
FIG.15A (CLOCK INTERRUPT ROUTINE)

(CLOCK INTERRUPT ROUTINE)

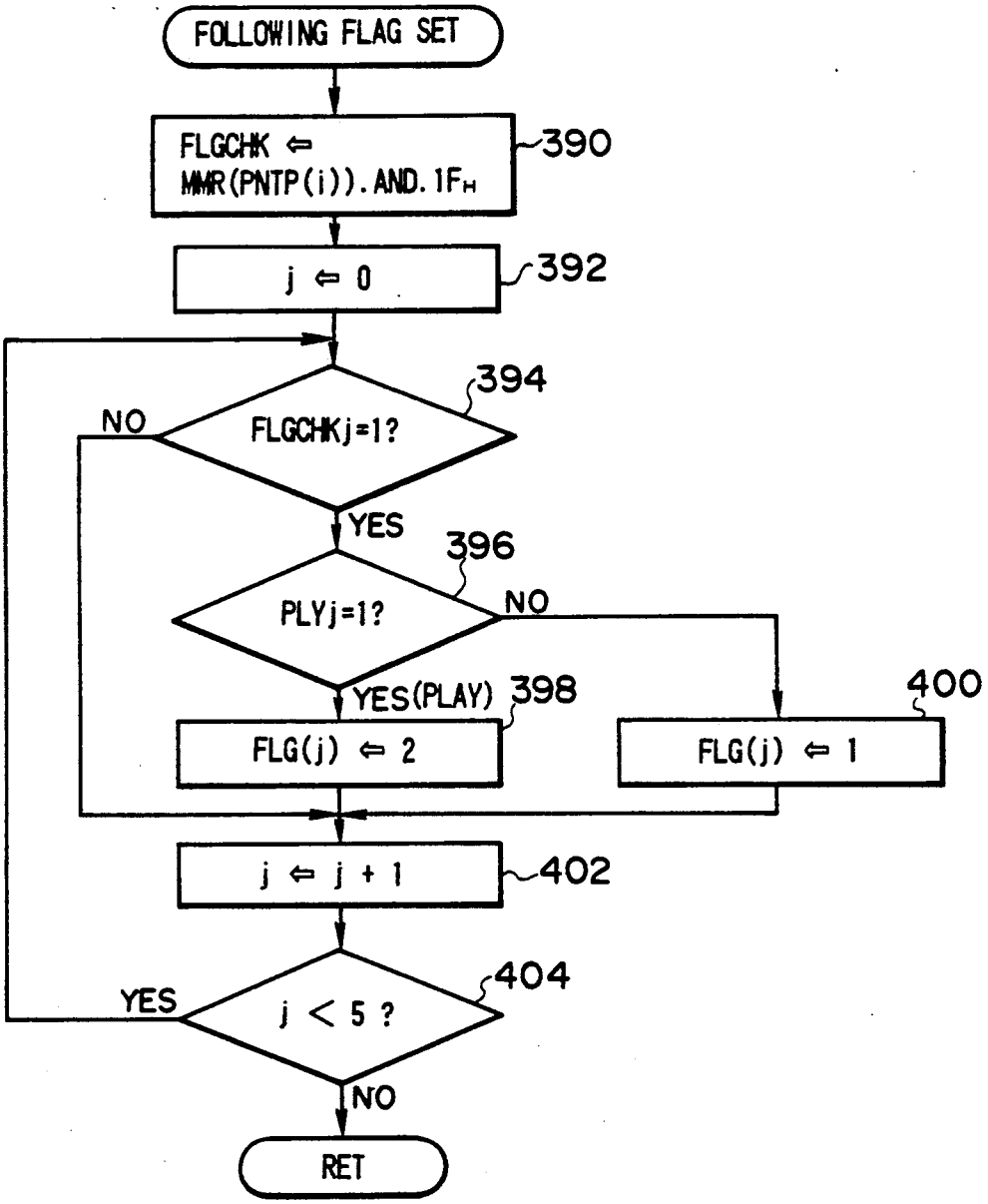
FIG.16 (FOLLOWING FLAG SET SUBROUTINE)

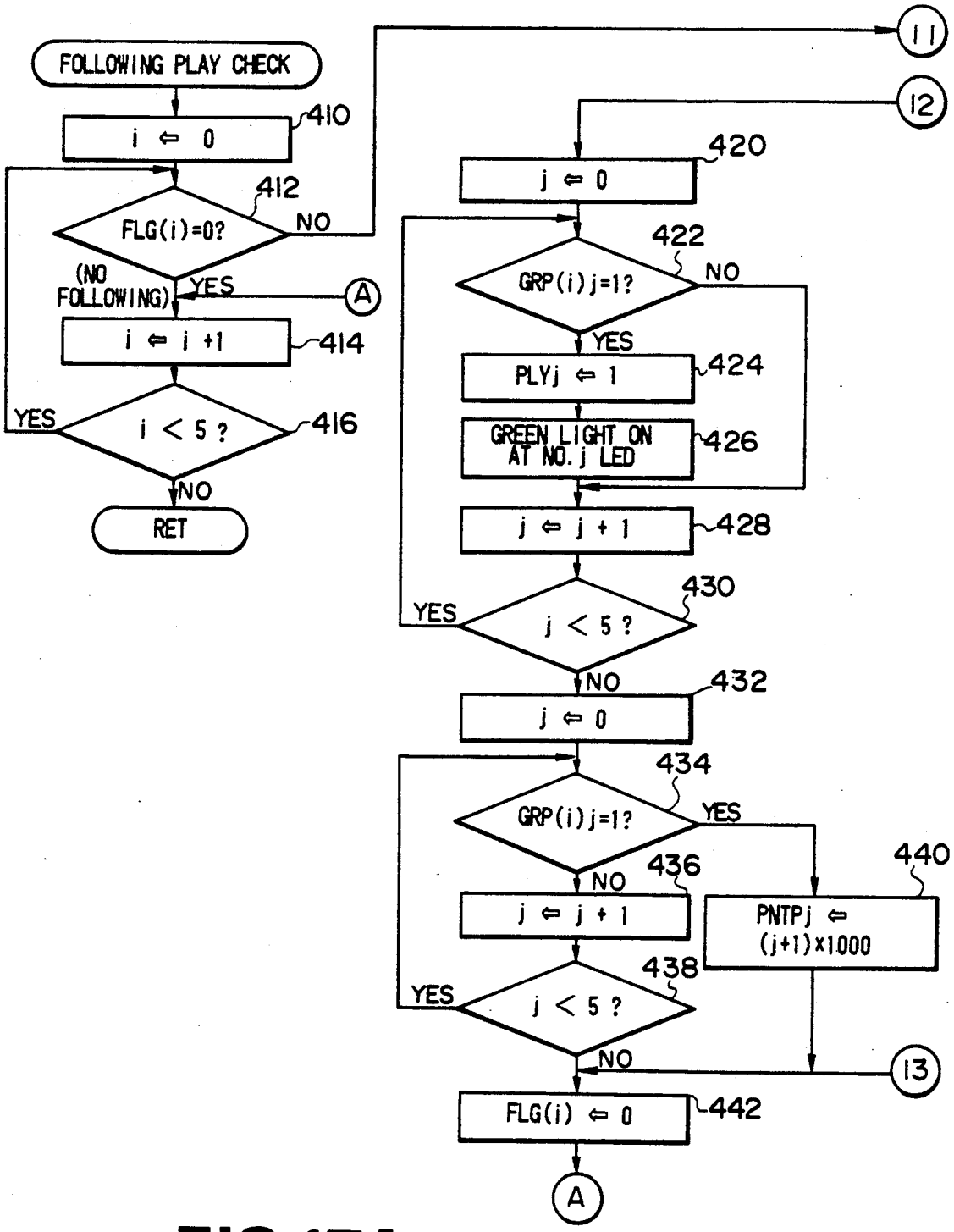
FIG.17A (FOLLOWING PLAY CHECK SUBROUTINE)

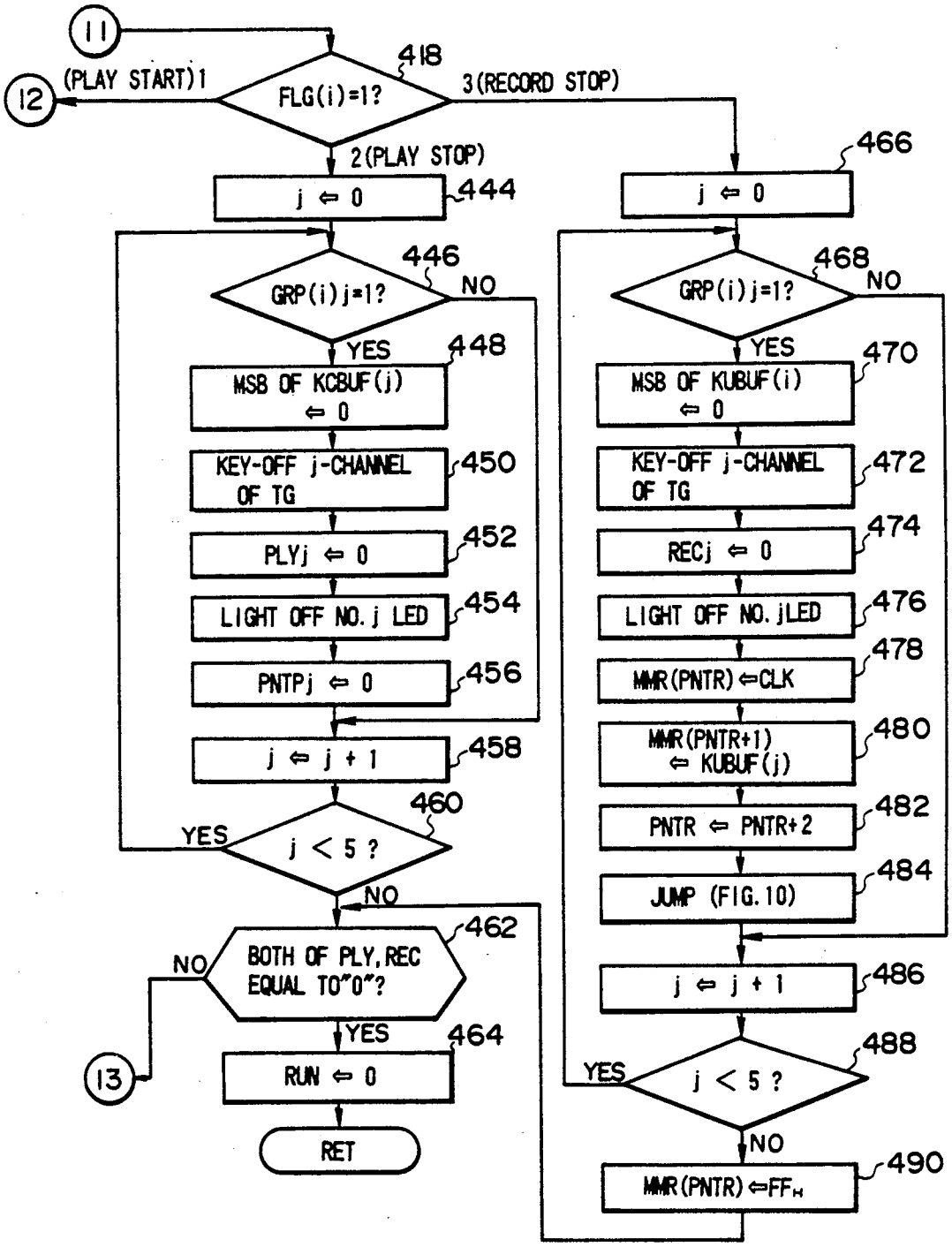
FIG. 17B (FOLLOWING PLAY CHECK SUBROUTINE)

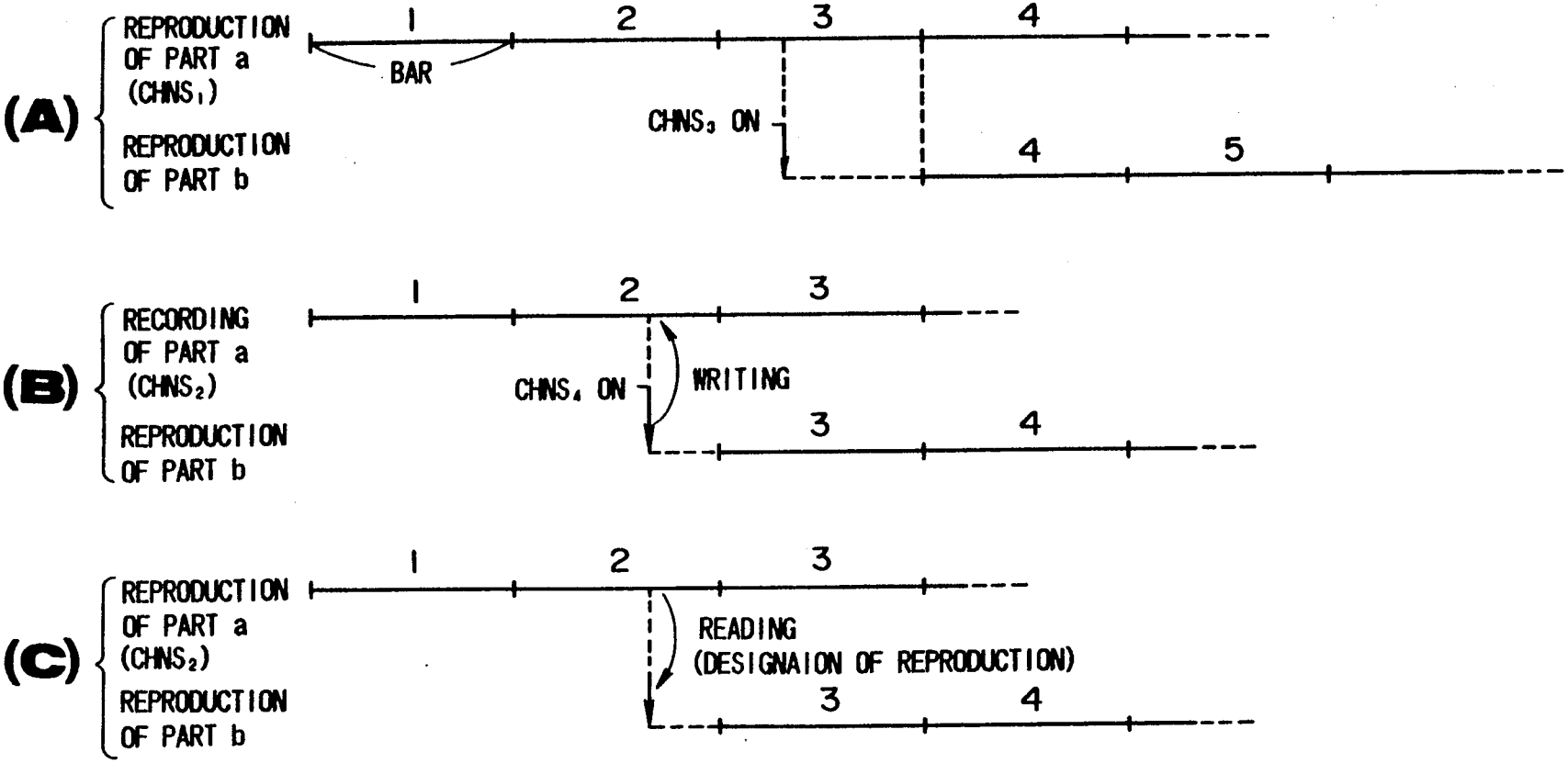
FIG. 18 (OPERATION EXAMPLE OF RECORDING & REPRODUCTION)

AUTOMATIC PERFORMANCE APPARATUS HAVING AUTOMATIC SYNCHRONIZING FUNCTION

BACKGROUND OF THE INVENTION

1. Field of the Invention

The present invention relates to an automatic performance apparatus, and more particularly to an automatic performance apparatus capable of recording or reproducing a performance to be played by its every part.

2. Prior Art

Conventionally known automatic performance apparatus can record and reproduce data indicative of a performance by each of its parts such as a melody part, a chord part, a bass part or the like (see Japanese Patent Laid-Open Publication No. 59-197095, for example). By use of this known apparatus, it is possible to mix an automatic performance tone based on reproduced performance data with another performance tone to be actually generated by playing an electronic musical instrument by each part.

The above-mentioned conventional apparatus can execute the recording or reproducing of data in one part (e.g., the melody part) and also execute the reproducing of data in another part (e.g., the chord part) in parallel. In addition, this conventional apparatus starts to record or reproduce the data in one part and also starts to reproduce the data in another part simultaneously. For this reason, the conventional apparatus cannot start to reproduce the chord part in order to additionally play a chord accompaniment in the middle of the reproduction of the melody part, or the conventional apparatus cannot start to reproduce the bass part in order to additionally play a bass accompaniment in the middle of the recording of the chord part, for example. Therefore, the conventional apparatus is disadvantageous in that the performance method must be limited.

In order to eliminate the above disadvantage, it is possible to modify the conventional apparatus into the apparatus capable of independently starting the recording and reproduction. However, such modified apparatus is disadvantageous in that the synchronization among the progressing bars of plural parts must be deviated frequently. In addition, it is difficult to perform the reproduction starting operation so that such deviation will be eliminated. Therefore, the conventional apparatus is inconvenient for the actual performance.

SUMMARY OF THE INVENTION

It is accordingly a primary object to provide an automatic performance apparatus which can play the various performances without complicating its operation.

It is another object of the present invention to provide an automatic performance apparatus capable of controlling the reproduction of one part in the music while another part of the music is played or reproduced.

In a first aspect of the present invention, there is provided an automatic performance apparatus comprising:

(a) memory means for storing performance information indicative of plural parts of a desirable tune;

(b) designating means capable of independently designating reproduction of each part;

(c) first detecting means for outputting a first detection signal when it is detected that reproduction of one part is designated and then reproduction of another part is designated;

(d) means for generating a tempo clock signal;

(e) second detecting means for detecting a section end of a performance section having a predetermined musical length in the tune to thereby generate a second detection signal based on the tempo clock signal; and (f) automatic performance means for sequentially reading the performance information concerning the one part based on the tempo clock signal so that automatic performance of the one part will be played when the reproduction of the one part is designated, the automatic performance means sequentially reading another performance information concerning another part based on the tempo clock signal from a timing synchronized with the second detection signal which is generated after the first detection signal so that automatic performance of the another part will be played.

In a second aspect of the present invention, there is provided an automatic performance apparatus comprising:

(a) tone pitch designating means capable of designating a tone pitch, the tone pitch designating means generating tone pitch information every time the tone pitch is designated;

(b) memory means capable of storing performance information of plural parts of a desirable tune;

(c) designating means capable of independently designating recording or reproduction of each part;

(d) means for generating a tempo clock signal;

(e) writing means for writing the tone pitch information and timing information based on the tempo clock signal into the memory means as the performance information of the part to be designated every time the tone pitch designating means generates the tone pitch information for the part designated by the designating means;

(f) first detecting means for outputting a first detection signal when it is detected that recording of one part is designated and then reproduction of another part is designated;

(g) second detecting means for detecting a section end of a performance section having a predetermined musical length in the tune to thereby generate a second detection signal based on the tempo clock signal; and (h) automatic performance means for sequentially reading the performance information concerning another part based on the tempo clock signal from a timing synchronized with the second detection signal which is generated after the first detection signal so that automatic performance of another part will be played.

In a third aspect of the present invention, there is provided an automatic performance apparatus comprising:

(a) memory means for storing plural parts of a desirable tune, the memory means storing reproduction designating information concerning another part of the desirable tune as partial performance information of one part;

(b) designating means capable of independently designating reproduction of each part;

(c) means for generating a tempo clock signal;

(d) detecting means for detecting a section end of a performance section having a predetermined musical length in the desirable tune based on the tempo clock signal to thereby generate a detection signal; and (e) automatic performance means for sequentially reading the performance information concerning the one part based on the tempo clock signal so that automatic performance of the one part will be played and the automatic performance means also detecting the reproduction designating information in according with a progress of reading the performance information concerning the one part when the designating means designates the reproduction of the one part, the automatic performance means sequentially reading the performance information concerning another part based on the tempo clock signal from a timing synchronized with the detection signal which is generated from the detecting means after the reproduction designating information is detected so that automatic performance of another part will be played.

BRIEF DESCRIPTION OF THE DRAWINGS

Further objects and advantages of the present invention will be apparent from the following description, reference being had to the accompanying drawings wherein a perferred embodiment of the present invention is clearly shown.

In the drawings:

FIG. 1 is a block diagram showing a configuration of an electronic musical instrument providing an automatic performance apparatus according to an embodiment of the present invention;

FIG. 2 shows the key codes corresponding to each tone name;

FIG. 3 shows a configuration of an auto-play memory shown in FIG. 1;

FIGS. 4(A) to 4(F) show data formats of the data stored in the auto-play memory;

FIG. 5 is a state transition diagram for explaining a mode change-over operation;

FIG. 6 is a state transition diagram for explaining a start/stop operation;

FIG. 7 is a flowchart showing a main routine;

FIG. 8 is a flowchart showing a key-on subroutine;

FIG. 9 is a flowchart showing a key-off subroutine;

FIG. 10 is a flowchart showing a jump subroutine;

FIGS. 11A and 11B are flowcharts showing a start/-stop subroutine;

FIG. 12 is a flowchart showing a record check subroutine;

FIGS. 13A and 13B are flowcharts showing a channel-number/part designating switch CHNS-on subroutine;

FIG. 14 is a flowchart showing a running CHNS-on subroutine;

FIGS. 15A and 15B are flowcharts showing a clock interrupt routine;

FIG. 16 is a flowchart showing a following flag set subroutine;

FIGS. 17A and 17B are flowcharts showing a following play check subroutine; and FIGS. 18(A) to 18(C) are time charts showing examples of recording and reproduction operations.

DESCRIPTION OF A PREFERRED EMBODIMENT

Figure 15B:
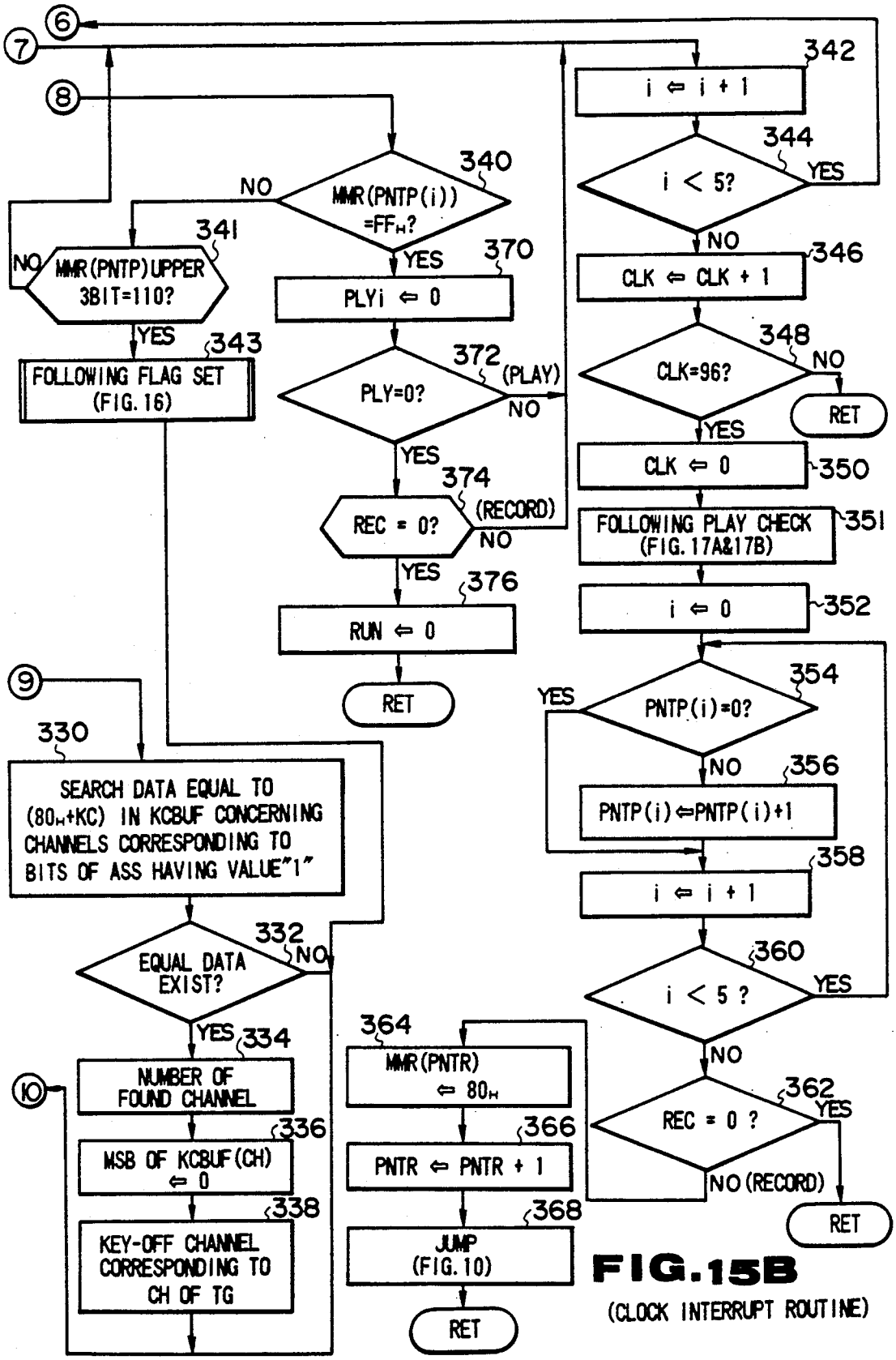

FIG. 1 shows a configuration of an electronic musical instrument which provides the automatic performance apparatus according to an embodiment of the present invention. This electronic musical instrument provides a micro-computer which controls the generation of manual performance tone, the recording and reproducing of manual performance information (i.e., the automatic performance) and the like.

CONFIGURATION OF AN EMBODIMENT

(1) Configuration of Electronic Musical Instrument (FIG. 1)

In FIG. 1, a data bus 10 is connected with a keyboard 12, a panel unit 14, a central processing unit (CPU) 16, a program memory 18, registers 20, an auto-play memory 22, a clock generator 24, a tone generator (TG) 26 and the like.

The keyboard 12 provides plural keys, wherein key-depression information is detected for each key.

The panel unit 14 includes several kinds of switches for controlling the musical tone and performance and several kinds of display elements. As for the switches and display elements concerning the present invention, there are five channel-number/part designating switches CHNS, corresponding to five display elements LED which are configured by light emitting diodes so that each display element can turn on red and green lights, a record mode designating switch RECS, a start/stop switch SPS, a synchro-start switch SYNS, and other members such as a volume control and a tempo control.

The CPU 16 executes several kinds of processes such as musical tone generating process, performance recording and reproducing process and the like in accordance with programs stored in the program memory 18. Later, detailed description will be given with respect to these processes by referring to FIGS. 7 to 17B.

The registers 20 include several kinds of registers which are used when the several kinds of processes are executed by the CPU 16. Later, description will be given with respect to the registers which concern the present embodiment within these registers.

The auto-play memory 22 stores the performance information, and this memory 22 can be constituted by a random access memory (RAM), for example. Later, description will be given with respect to the configuration of the memory 22 and formats of several data stored in the memory 22 by referring to FIGS. 3 and 4.

The clock generator 24 generates a tempo clock signal TCL having a frequency corresponding to the set tempo which corresponds to tempo data TD. This signal TCL includes plural clock pulses each of which is used for starting a clock interrupt routine shown in FIG. 14.

The tone generator 26 has eight tone-generation channels which are numbered by No. 0 to No. 7. Each of No. 0 to No. 4 channels can be independently used for the automatic performance, while other No. 5 to No. 7 channels are exclusively used for the manual performance. Within No. 0 to No. 4 channels, the channel which is not used for the automatic performance can be used for the manual performance.

A sound system 28 shown in FIG. 1 converts the musical tone signal supplied from the tone generator 26 into the acoustic. This sound system 28 comprises an output amplifier, a speaker and the like.

In the above-mentioned electronic musical instrument, a tone name is assigned to each key code as shown in FIG. 2.

(2) Auto-Play Memory 22 (FIGS. 3 and 4)

FIG. 3 shows the configuration of the auto-play memory 22 which provides five storing blocks B0 to B4 respectively corresponding to No. 0 to No. 4 channel-number/part designating switches CHNS. Each of these storing blocks B0 to B4 includes one thousand storing areas each capable of storing data of one byte (i.e., eight bits). In addition, addresses 1000 to 1999 are given to the storing block B0, addresses 2000 to 2999 are given to the storing block B1, addresses 3000 to 3999 are given to the storing block B2, addresses 4000 to 4999 are given to the storing block B3 and addresses 5000 to 5999 are given to the storing block B4. In the following description, the specific storing area or storing data at the address ADRS will be designated by MMR(ADRS).

FIG. 4 shows the data formats of the memory 22. As shown in FIG. 4, the performance information to be stored in the memory 22 includes (a) key-on information, (b) key-off information, (c) bar line information, (d) jump information, (e) following operation information and (f) and information.

(a) The key-on information comprises timing information and key code information both of which are the data of one byte. In the timing information, its most significant bit (MSB) takes the value "0" and data of other seven bits indicates a key-on timing (i.e., count value of the tempo clock signal TCL). In the key code information, its MSB takes the value "1" and data of other seven bits indicates the key code whose key is on.

(b) The key-off information comprises timing information and key code information both of which are the data of one byte. In the timing information, its MSB takes the value "0" and data of other seven bits indicates a key-off timing. In the key code information, its MSB takes the value "1" and data of other seven bits indicates the key code whose key is off.

(c) The bar line information is the data of one byte which is the data $80_H$ (i.e., data (10000000)). Hereinafter, the suffix "$_H$" means the hexadecimal notation.

(d) The jump information is the data of one byte, wherein data of upper four bits is the data $E_H$ (i.e., data (1110)) and another data of lower four bits designates the destination to be jumped (i.e., one of the four blocks B1 to B4). The data of lower four bits which is identical to data $F_H$ (i.e., data (1111)) designates a storing stop position.

(e) The following operation information is the data of one byte, wherein data of upper three bits is identical to data (110) and lower five bits respectively correspond to the No. 0 to No. 4 channel-number/part designating switches CHNS. When any one of these switches CHNS is turned on the recording or reproduction (i.e., the following operation is carried out on any one of these switches CHNS), the corresponding one of the lower five bits takes the value "1".

(f) The end information is the data of one byte which is identical to data $FF_H$ (i.e., data (11111111)).

OPERATION OF AN EMBODIMENT

Next, description will be given with respect to the operation of the present embodiment.

(1) Mode Change-Over Operation (FIG. 5)

Next, diagrammatical description will be given with respect to the mode change-over operation by referring to FIG. 5.

As the modes which can be set, there are normal mode, record mode and play mode. In the normal mode, the performance with the keyboard 12 can be played, but its performance information can not be recorded or reproduced. In the record mode, the performance information is recorded in the auto-play memory 22 in accordance with the manual performance. In the play mode, the automatic performance is played based on the performance information recorded in the memory 22. In this play mode, it is also possible to play the manual performance.

The mode change-over operation can be done every time each channel-number/part designating switch CHNS is operated. By operating the No. 0 to No. 4 switches CHNS, it is possible to set the state where an arbitrary one of the above-mentioned three modes is selected and another state where some of the three modes are arbitrarily selected. FIG. 5 shows an example of the mode change-over operation which is carried out by operating the specific one of the switches CHNS and the record mode designating switch RECS.

In the normal mode, the display element LED corresponding to the specific switch CHNS is off. In this state, when only the switch CHNS only turned on, the play mode is selected so that the green light of LED is on. In the normal mode, when both of the switches RECS and CHNS are simultaneously turned on, the record mode is selected so that the red light of LED is on.

In the play mode, when the switches RECS and CHNS are simultaneously turned on, the record mode is selected. In the record mode, when only the switch CHNS only turned on, the normal mode is selected. However, in the record mode, when only the switches RECS and CHNS are simultaneously turned on, this record mode is maintained.

The above-mentioned manipulation is the basic manipulation concerning one switch CHNS. However, when this one switch is operated in combination with other switches CHNS, the following operations (a) to (c) will be done. In this case, the operable switches CHNS are included within the group consisting of plural switches CHNS whose mode is set to the record mode when a run flag RUN (which will be described later) takes the value "1" by operating the start/stop switch SPS.

(a) In the case where the mode of one switch CHNS is changed from the normal mode to the play mode while the mode of another switch CHNS is the record mode, the record mode of another switch is changed over to the play mode when these two switches CHNS are included in the group. As a result, the modes of these switches CHNS are both set to the play mode. For example, after the modes of No. 2 to No. 4 switches CHNS are all set to the record mode, the value of run flag RUN is set equal to "1" so that the code performance is recorded. Then, when any one of No. 2 to No. 4 switches CHNS is turned on, the mode of this on-switch is set to the normal mode. Thereafter, this on-switch is further turned on, the normal mode of this on-switch is changed over to the play mode. In this case, the modes of other switches within the group to which this on-switch belongs are all set to the play mode. In other words, plural switches CHNS corresponding to the desirable channel number must be operated in the recording. In contrast, in the reproduction, the desirable part can be selected by operating only one of these switches CHNS.

(b) When the play mode of one switch CHNS is changed over to the record mode, the modes of other switches CHNS within the group to which one switch CHNS belongs must be set to the normal mode. For example, when the modes of No. 2 to No. 4 switches CHNS are all set to the play mode and then the mode of No. 2 switch is changed over to the record mode, the play modes of other No. 3 and No. 4 switches must be turned to the normal mode.

(c) When the play mode of one switch CHNS is turned to the normal mode, the modes of other switches within the group to which one switch CHNS belongs must be turned to the normal mode. For example, when the modes of No. 2 to No. 4 switches are set to the play mode and then only the play mode of the No. 2 switch is turned to the normal mode, the play modes of the No. 3 and No. 4 switches must be turned to normal mode.

(2) Start/Stop Operation (FIG. 6)

Next, a diagrammatical description will be given with respect to the start/stop operation by referring to FIG. 6.

In a stop state of RUN=0, when the start/stop switch SPS is turned on, the value of run flag RUN is turned to "1" so that the running state is set. In this running state, the counting operation of the tempo clock signal TCL is executed by the clock interrupt routine which will be described later in conjunction with FIGS. 15A and 15B. In the running state of RUN=1, when the switch SPS is turned on, the stop state of RUN=0 is set.

Meanwhile, in the stop state of RUN=0 or the running state of RUN=1, when the synchro-start switch SYNS is turned on, a synchro-standby state of RUN=−1 is set. In this synchro-standby state, when the switch SPS is turned on or any key-on event occurs in the keyboard 12, the running state of RUN=1 is set.

In the stop state of RUN=0, the operation of normal mode can be carried out. In the running state of RUN=1, the operation of record mode and/or play mode can be carried out. In the synchro-standby state of RUN=−1, it is possible to start the operation of record mode and/or play mode in synchronism with the key-on start timing of the keyboard 12.

(3) Registers 20

The registers included in the registers 20 which are concerned with the present embodiment will be listed as follows.

(a) Run flag RUN: This is the one-bit register which represents the stop state at value "0"; the running state at value "1"; and the synchro-standby state at value "−1".

(b) Record mode register REC: This is a five-bit register each bit corresponding to each of No. 0 to No. 4 switches CHNS, wherein the mode of switch CHNS corresponding to its bit which takes value "1" is set to the record mode.

(c) Play mode register, PLY: This is a five-bit register each bit corresponding to each of No. 0 to No. 4 switches CHNS, wherein the mode of switch CHNS corresponding to its bit which takes value "0" is set to the play mode.

(d) Clock counter CLK: This counter repeatedly counts the pulse number of tempo clock signal TCL by each bar, wherein its count value varies between "0" to "95" so that it is reset to "0" at the timing when reaching at "96".

(e) Group state registers GRP(0) to GRP(4): Each of these registers corresponds to each of No. 0 to No. 4 switches CHNS, wherein each register, is designed as a five-bit register each bit corresponding to each of No. 0 to No. 4 switches CHNS. Each register indicates the members of switches in its group. For example, in the case where No. 0 and No. 1 switches belong to a first group and the No. 2 to No. 4 switches belong to a second group, the contents of data stored in the registers GRP(0) to GRP(4) can be expressed as follows, wherein the leftmost value of the data is the MSB.

| REGISTER | DATA |
|---|---|
| GRP(0) | 000011 |
| GRP(1) | 000011 |
| GRP(2) | 111100 |
| GRP(3) | 111100 |
| GRP(4) | 111100 |

(f) Key code register KC: This is the seven-bit register which stores the key code information corresponding to the key at which the key event (i.e., key-on or key-off) occurs in the keyboard 12.

(g) Key code buffer registers KCBUF(0) to KCBUF(7): Each of these registers corresponds to each of No. 0 to No. 7 tone-generation channels in the tone generator 26, wherein each register is the eight-bit register. The value "1" or "0" corresponding to the key-on or key-off, respectively, is stored in the MSB and key code information is stored in the lower seven bits of this eight-bit register.

(h) Reading key code register KEY: This is the eight-bit register for storing the key code information read from the auto-play memory 22, wherein the value "1" or "0" corresponding to the key-on or key-off, respectively, is stored in its MSB and the key code is stored in its lower seven bits.

(i) Key-on register KON: This is the one-bit register to which the value of MSB of the register KEY is set.

(j) Writing address pointer PNTR: This register is used for writing information into the auto-play memory 22 in the record mode, and this register can store address information of sixteen bits. In the record mode, one or some of the storing blocks B0 to B4 are designated by the switches CHNS so that the performance information is written into the memory 22 by one part. After completing the writing, No. 1 to No. 4 switches CHNS designate the storing blocks B1 to B4 into which the code performance information is written. In this case, these four storing blocks B1 to B4 work as one storing block. Since the writing operation is carried out by one part as described above, it is enough to provide only one pointer PNTR.

(k) Reading address pointers PNTP(0) to PNTP(4): These pointers are used for reading information from the auto-play memory 22 in the play mode, wherein each of these pointers corresponds to each of the storing blocks B0 to B4. The reason why these five pointers are provided is to enable the reading operation of each block in the case where the performance information of each part is written into each of the storing blocks B0 to B4. Each pointer can store the address information of sixteen bits. In the mode other than the play mode, the value of each of the pointers PNTP(0) to PNTP(4) is equal to "0". When the operation of play mode is started under the state where the modes of plural switches CHNS are all set to the play mode due to the condition of group, the head address of the storing block corresponding to the switch whose number is the smallest within the group is set to its corresponding pointer. For example, in the case where No. 0 to No. 2 switches constitutes the group, the head address of storing block B0 is set to the pointer PNTP(0) but this head address is not set to other pointers PNTP(1) and PNTP(2) because the storing blocks B0 to B2 work as one continuous storing block. Therefore, the pointer PNTP(0) is used for reading information from the storing blocks B0 to B4 but other pointers PNTP(1) and PNTP(2) are not used.

(l) Temporary register TMP: This register temporarily stores the contents of register PLY when the head address is set to the pointers PNTP(0) to PNTP(4), wherein this register is configured similar to the register PLY.

(m) Assignable channel register ASS: This is the eight-bit register each bit corresponding to each of No. 0 to No. 7 tone-generation channels of the tone generator 26. When any one bit of this eight-bit register takes the value "1", it is indicated that the channel corresponding to such bit can be assigned.

(n) Assigning channel register CH: This register is set by the number of the channel to which the key code information must be actually assigned.

(o) Jump destination register GT: This is the four-bit register which stores the number (i.e., "1" to "4") of the destination storing block to be jumped or the data $F_H$ (i.e., storing stop position information).

(p) Following flags FLG(0) to FLG(4): Each of these registers corresponds to each of No. 0 to No. 4 switches CHNS, wherein any one of values "0" to "3" is set to each register. Herein, value "0" designates non-following operation, value "1" designates the following operation and the play start, value "2" designates the following operation and the play stop, and value "3" designates the following operation and the record stop.

(q) Following operation information register FLGCHK: This is the five-bit register each bit corresponding to each of No. 0 to No. 4 switches CHNS. This register stores data of lower five bits (i.e., data indicative of the switch CHNS on which the following operation is carried out) within the following operation information read from the memory 22.

(4) Main Routine (FIG. 7)

FIG. 7 shows the process flow of main routine, which is started in response to the power on.

In first step 30, several registers are initialized. For example, the value "0" is set to the registers RUN, KCBUF(0) to KCBUF(4), GRP(0) to GRP(4) etc. Then, the processing proceeds to step 32.

In step 32, it is judged whether the key-on event occurs in the keyboard 12 or not. If the judgement result of this step 32 is "YES", the processing proceeds to next step 34 wherein the CPU 16 executes the key-on subroutine which will be described later in conjunction with FIG. 8.

After completing the process of step 34 or if the judgement result of step 32 is "NO", the processing proceeds to step 36 wherein it is judged whether the key-off event occurs in the keyboard 12 or not. If the judgement result of step 36 is "YES", the processing proceeds to step 38 wherein the CPU 16 executes the key-off subroutine which will be described later in conjunction with FIG. 9.

After completing the process of step 38 or if the judgement result of step 36 is "NO", the processing proceeds to step 40 wherein it is judged whether the on-event occurs in the start/stop switch SPS or not. If the judgement result of step 40 is "YES", the processing proceeds to step 42 wherein the CPU 16 executes the start/stop subroutine which will be described later in conjunction with FIGS. 11A and 11B.

After completing the process of step 42 or if the judgement result of step 40 is "NO", the processing proceeds to step 44 wherein it is judged whether the on-event occurs in the synchro-start switch SYNS or not. If the judgement result of step 44 is "YES", the processing proceeds to step 46 wherein it is judged whether the run flag RUN takes the value "−1" (i.e., the synchro-standby state) or not. If the judgement result of step 46 is "NO", the run flag RUN must take the value "0" or "1", whereby the processing proceeds to step 48. In step 48, it is judged whether the values of registers PLY and REC both take the value "0" (i.e., the modes of switches CHNS are all set to the normal mode) or not. If the judgement result of step 48 is "NO", it is found that the present mode is set to the play mode or record mode. Then, the processing proceeds to step 50 wherein the value "−1" is set to the run flag RUN so that the synchro-standby state is set.

On the other hand, if the judgement result of step 46 is "YES", the processing proceeds to step 52 wherein the value "0" is set to the run flag RUN so that the stop state is set.

After completing the process of step 50 or 52, if the judgement result of step 44 is "NO" or if the judgement result of step 48 is "YES", the processing proceeds to step 54.

In step 54, a control variable i is set equal to "0", and then the processing proceeds to step 56 wherein it is judged whether or not the on-event occurs in No. i channel-number/part designating switch CHNSi. If the judgement result of step 56 is "YES", the processing proceeds to step 58 wherein the CPU 16 executes the CHNS-on subroutine which will be described later in conjunction with FIGS. 13A and 13B.

After completing the process of step 58 or if the judgement result of step 56 is "NO", the processing proceeds to step 60 wherein the control variable i is incremented by one, and then the processing proceeds to step 62.

In step 62, it is judged whether the control variable i is smaller than the number (i.e., "5") of switches CHNS or not. If the judgement result of step 62 is "YES", the processing returns to step 56, so that the processes of steps 56 to 62 are repeatedly executed until the control variable i becomes equal to "5". As a result, the processes of CHNS-on subroutine are carried out on one or some of the switches CHNS0 to CHNS4 on which the on-event occurs.

When the control variable i reaches at "5", the judgement result of step 62 turns to "NO", so that the processing proceeds to step 64 wherein other processes (concerning the tone volume, tempo and the like) are carried out. Then, the processing returns to step 32. Thereafter, the processes described heretofore are repeatedly carried out.

(5) Key-On Subroutine (FIG. 8)

In the key-on subroutine shown in FIG. 8, step 70 judges whether RUN=−1 (i.e., the synchro-standby state) is set or not. If the judgement result of step 70 is "YES", the processing proceeds to step 72 wherein the CPU 16 executes the start/stop subroutine shown in FIGS. 11A and 11B.

After completing the process of step 72 or if the judgement result of step 70 turns to "NO", the processing proceeds to step 74 wherein it is judged whether REC=0 (i.e., the normal mode or play mode) is set or not. If the judgement result of step 74 is "YES", the processing proceeds to step 76.

In step 76, an OR operation is carried out between the data $EO_H$ and $\overline{PLY}$ which is obtained by inverting the values of all bits of data stored in the register PLY, and then its operation result is entered into the register ASS. In this case, the OR operation is carried out in order to detect the assignable channels. For example, if the data stored in the register PLY is data (11100), the operation result is data (11100011), so that No. 0, No. 1, No. 5 to No. 7 channels become assignable.

If the judgement result of step 74 is "NO", it is found that the mode of any one of the switches CHNS is set to the record mode. Then, the processing proceeds to step 78 wherein the data of register REC is entered into the register ASS. For example, if the data of register REC is data (00011), this data may be entered into the register ASS so that No. 0 and No. 1 channels become assignable.

After completing the process of step 76 or 78, the processing proceeds to step 80, wherein the number of the channel whose musical tone is the most attenuate within the channels corresponding to the bits having value "1" in all bits of register ASS is inputted into the register CH. For example, in the case where the bits register ASS corresponding to No. 0 and No. 1 channels take the value "1" and the musical tone of No. 0 channel is the most attenuate, the value "0" is set to the register CH.

In next step 82, addition result of data $80_H$ and data of register KC is stored in the register KCBUF(CH) corresponding to the channel number of register CH. Due to this addition, the value "1" is added as the eighth bit of data of key code corresponding to the key on which the key-on event occurs so that the eight-bit data indicative of the key code information is obtained. By entering this key code information into the register KCBUF(CH), it is possible to assign the key code information to the channel corresponding to the data of register CH. After completing the process of step 82, the processing proceeds to step 84.

In step 84, the key-on process is carried out on the channel of register CH within the tone generator 26 by the key code of register KC so that the musical tone corresponding to such key code will be generated. Then, the processing proceeds to next step 86.

In step 86, it is judged whether REC=0 (i.e., the normal mode or play mode is set) or not. If the judgement result of step 86 is "YES", the processing returns to the main routine shown in FIG. 7. Incidentally, "RET" shown in FIG. 8 etc. indicates "RETURN".

When the judgement result of step 86 is "NO", it is found that the record mode is set to any one of the switches CHNS, and then the processing proceeds to step 88. In step 88, the value of counter CLK (i.e., key-on timing information) is written into an address storing area MMR(PNTR) which is indicated by the value of pointer PNTR in the auto-play memory 22. Then, the processing proceeds to step 90.

In step 90, the key code information of register KCBUF(CH) is written into an address storing area MMR(PNTR+1) next to the area MMR(PNTR). In next step 92, the value of pointer PNTR is incremented by two, and then the processing proceeds to step 94.

In step 94, the CPU 16 executes the jump subroutine which will be described later in conjunction with FIG. 10. Thereafter, the processing returns to the main routine shown in FIG. 7.

(6) Key-Off Subroutine (FIG. 9)

In the key-off subroutine shown in FIG. 9, steps 100, 102 and 104 are respectively identical to foregoing steps 74, 76 and 78. More specifically, step 100 judges whether REC=0 or not. Then, the processing proceeds to step 102 if the judgement result of step 100 is "YES", while the processing proceeds to step 104 if the judgement result of step 100 is "NO". In step 102, the result of the OR operation carried out between the data $EO_H$ and data $\overline{PLY}$ is entered into the register ASS. In step 104, the data of register REC is entered into the register ASS.

After completing the process of step 102 or 104, the processing proceeds to step 106. In step 106, the CPU 16 searches the data equal to the data ($80_H$+KC) within the data of register KCBUF concerning the channels which correspond to the bits having value "1" within the data of register ASS. This data ($80_H$+KC) is obtained by adding the value "1" as the eighth bit of data indicative of the key code whose key is off. Therefore, searching the data equal to this data ($80_H$+KC) from the data of register KCBUF is equivalent to searching the channel to which the key code equal to the key code whose key is off has been already assigned.

In next step 108, it is judged whether the above-mentioned equal data exists or not. If the judgement result of step 108 is "YES", the processing proceeds to step 110 wherein the number of the assigned channel to be found is inputted into the register CH. Then, the processing proceeds to step 112.

In step 112, the MSB of data of register KCBUF(CH) is set to "0". As a result, this enables the key code information stored in the register KCBUF(CH) to be written as the key-off information. Thereafter, in step 114, the key-off process is carried out on the channel corresponding to the data of register CH so that the musical tone signal which is generated is muted.

After completing the process of step 114 or if the judgement result of step 108 is "NO", the processing proceeds to step 116 wherein it is judged whether REC=0 or not as similar to foregoing step 86. If the judgement result of step 116 is "YES", the processing returns to the main routine shown in FIG. 7.

If the judgement result of step 116 is "NO", the processing proceeds to step 118 wherein the value of counter CLK (i.e., key-off timing information) is written into the address storing area MMR(PNTR). Then, the processing proceeds to step 120.

In step 120, the key code information of register KCBUF(CH) is written into the address storing area MMR(PNTR+1). In next step 122, the value of pointer PNTR is incremented by two, and then the processing proceeds to step 124.

In step 124, the jump subroutine as shown in FIG. 10 is carried out. Thereafter, the processing returns to the main routine shown in FIG. 7.

(7) Jump Subroutine (FIG. 10)

In the jump subroutine shown in FIG. 10, step 130 judged whether the data of address storing area MMR(PNTR) is data $EX_H$ or not. Herein, "X" indicates the lower four bits whose value can be set arbitrarily. Therefore, the data $EX_H$ corresponds to the jump mark. If the judgement result of step 130 is "NO", the processing returns to the original routine.

If the judgement result of step 130 is "YES", the processing proceeds to step 132 wherein it is judged whether the above-mentioned "X" (i.e., lower four bits) designates data $F_H$ (i.e., storing stop position) or not. If the judgement result of step 132 is "YES", the value "0" is set to the run flag RUN in next step 134. Then, the processing proceeds to step 136 wherein the data $FF_H$ (i.e., end information) is written into the address storing area MMR(PNTR). Thereafter, the processing returns to the original routine.

If the judgement result of step 132 is "NO", the processing proceeds to step 138 wherein the head address of jump destination is calculated in accordance with the formula $(X+1)\times 1000$. Then, the calculation result is set to the pointer PNTR. Therefore, in case of $X-1$, the value 2000 is set to the pointer PNTR so that the jump operation can be carried out on the storing block B1. After completing the process of step 138, the processing returns to the original routine.

(8) Start/Stop Subroutine (FIGS. 11A and 11B)

In the start/stop subroutine shown in FIGS. 11A and 11B, first step 140 judged whether RUN=1 (i.e., the running state is set) or not. If the judgement result of step 140 is "YES", it is judged that the switch SPS is turned on in the running state. Thus, the value "0" is set to the run flag RUN in step 142 (shown in FIG. 11B) so that the stop state is set. Then, the processing proceeds to step 144.

In step 144, it is judged whether PLY=0 (i.e., normal mode or record mode is set) or not. If the judgement result of step 144 is "NO", it is found that the mode of any one of the switches CHNS must be the play mode. Then, the processing proceeds to step 146.

In step 146, the value "0" is set as the control variable i. Then, the processing proceeds to step 148 wherein it is judged whether the value "1" is written in No. i bit PLYi of the register PLY or not. If the judgement result of step 148 is "YES", it is found that the play mode was set to No. i switch CHNS. Then, the processing proceeds to step 150.

In step 150, the value "0" is set to the MSB of data stored in the register KCBUF(i) corresponding to No. i channel. Then, the processing proceeds to step 152 wherein the key-off process is carried out on No. i channel of the tone generator 26.

Next, the control variable i is incremented by one in step 154, and then the processing proceeds to step 156 wherein it is judged whether the control variable i is smaller than "5" or not. If the judgement result of step 156 is "YES", the processing returns to step 148. Thus, the processes of steps 148 to 156 are repeatedly carried out until the control variable i becomes equal to "5". As a result, the key-off process is carried out on all of the channels whose modes are set to the play mode.

When the control variable i becomes equal to "5", the judgement result of step 156 turns to "NO". Then, the processing proceeds to step 158 wherein the value "0" is set to the register PLY.

After completing the process of step 158 or if the judgement result of step 144 is "YES", the processing proceeds to step 160 wherein it is judged whether REC=0 (i.e., the normal mode is set) or not. If the judgement result of step 160 is "YES", the processing returns to the original routine.

If the judgement result of step 160 is "NO", it is found that the record mode was set to any one of the switches CHNS, so that the processing proceeds to step 162.

In step 162, the data $FF_H$ (i.e., end information) is written into the address storing area MMR(PNTR). Thereafter, the processing returns to the original routine.

On the other hand, when the judgement result of step 140 (shown in FIG. 11A) is "NO", it is found that the stop state or synchro-standby state was set, so that the processing proceeds to step 164 wherein it is judged whether both of registers PLY and REC take the value "0" (i.e., the normal mode) or not. If the judgement result of step 164 is "YES", the processing returns to the original routine.

If the judgement result of step 164 is "NO", the processing proceeds to step 166 wherein the value "1" is set to the run flag RUN and the value "0" is set to the clock counter CLK in order to start the running. Then, the processing proceeds to step 168 wherein the CPU 16 executes the record check subroutine which will be described later in conjunction with FIG. 12.

In step 170, the data stored in the register PLY is set to the register TMP. In next step 172, the value "0" is set to all of the pointers PNTP(0) to PNTP(4). Thereafter, the processing proceeds to step 174.

In step 174, the value "0" is set to the control variable i. In next step 176, it is judged whether or not the value "1" is set to No. i bit TMPi of the register TMP. If the judgement result of step 176 is "YES", it is found that the play mode was set to No. i switch CHNS. Then, the processing proceeds to step 178.

In step 178, the head address is set to the pointer PNTP(i) corresponding to No. i storing block. In this case, this head address is obtained by the formula $(i+1)\times 1000$. For example, in case of i=0, the value 1000 is set to the pointer PNTP(0) as the head address of storing block B0. Thereafter, the processing proceeds to step 180.

In step 180, the AND operation is executed between the data of register TMP and data $\overline{GRP}$)/ which is obtained by inverting all bit values of data of the register GRP(i) corresponding to No. i switch CHNS. In this case, the AND operation is executed in order to set the head address only to the pointer corresponding to the switch whose number is the smallest within the switches CHNS in the group. For example, the play mode is set to both of No. 0 and No. 1 switches CHNS so that the data (00011) is stored in the register TMP, while No. 0 and No. 2 switches CHNS are included in the same group so that data (00101) is stored in both of the registers GRP(0) and GRP(2). In this case, data (00010) is set to the register TMP by the result of AND operation. In this example, in case of i=0, the head address 1000 is set to the pointer PNTP(0) by the step 178.

After completing the process of step 180 or if the judgement result of step 176 is "NO", the control variable i is incremented by one in step 182, and then the processing proceeds to next step 184.

In step 184, it is judged whether the control variable i is smaller than "5" or not. If the judgement result of step 184 is "YES", the processing returns to step 176. Then, until the control variable i becomes equal to "5", the processes of steps 176 to 184 are repeatedly carried out. In the above-mentioned example, in case of i=0, the data (00010) is set to the register TMP in step 180. Then, the value "1" is set to the control variable i in step 182. Thereafter, when the processing returns to step 176 via step 184, the judgement result of step 176 turns to "YES". Therefore, the address 2000 is set to the pointer PNTP(1) in step 178. In step 180, when the value "0" is set to all bits of the register GRP(1) (i.e., No. 1 switch CHNS does not belong to the group of other switches CHNS), the data (00011) is set to the register TMP. Thereafter, when the value "2" is set to the control variable i in step 182 and then the processing returns to step 176 via step 184, the value of $TMP_2 2$ is set equal to "0" so that the judgement result of step 176 is turned to "NO". Then, the processing proceeds to step 182. Therefore, the head address is not set to the pointer PNTP(2) so that its value is maintained at "0".

When the control variable i becomes equal to "5", the judgement result of step 184 turns to "NO", so that the processing proceeds to step 185 wherein the value "0" is set to the control variable i. Then, the processing proceeds to step 186.

In step 186, it is judged whether the value "1" is set to No. i bit RECi of the register REC (i.e., the record mode is set to No. i switch CHNS) or not. If the judgement result of step 186 is "YES", the processing proceeds to step 187 wherein the head address which is calculated by the formula $(i+1)\times 1000$ is set to the pointer PNTR. This set address is used as the head address in the writing. After completing the process of step 187, the processing returns to the original routine. Therefore, even when the data of register REC designates the record mode for plural switches CHNS, the operation of setting the head address in step 187 is carried out on the switch whose number is the smallest within such plural switches CHNS by one time.

If the judgement result of step 186 is "NO", the control variable is incremented by one in step 188. In next step 189, it is judged whether the control variable i is smaller than "5" or not. If the judgement result of step 189 is "YES", the processing returns to step 186. Thus, the processes of steps 186 to 189 are repeatedly carried out until the control variable i becomes equal to "5".

When the control variable i becomes equal to "5", the judgement result of step 189 turns to "NO", so that the processing returns to the original routine.

(9) Record Check Subroutine (FIG. 12)

In the record check subroutine shown in FIG. 12, the value "0" is set to the control variable i in step 190. Then, the processing proceeds to step 192.

In step 192, it is judged whether the value "1" is set to No. i bit RECi of the register REC or not. If the judgement result of step 192 is "YES", it is found that the record mode was set to any one of the switches CHNS. In next step 194, the mark i is changed to j in the control variable. Then, the processing proceeds to step 196.

In step 196, it is judged whether or not the value "1" is set to No. i bit of the register GRP(j) corresponding to No. j switch CHNS. If the judgement result of step 196 is "YES", the value "0" is set to the register GRP(j) in next step 198.

After completing the process of step 198 or if the judgement result of step 196 is "NO", the value j is incremented by one in step 200. In next step 202, it is judged whether the value j is smaller than "5" or not. If the judgement result of step 202 is "YES", the processing returns to step 196. Therefore, the processes of steps 196 to 202 are repeatedly executed until the value j becomes equal to "5".

When the value j becomes equal to "5", the judgement result of step 202 turns to "NO" so that the processing proceeds to step 204. In step 204, the data of register REC is set to the register GRP(i) corresponding to No. i switch CHNS.

After completing the process of step 204 or if the judgement result of step 192 is "NO", the value i is incremented by one in step 206, and then the processing proceeds to step 208 wherein it is judged whether the value i is smaller than "5" or not. If the judgement result of step 208 is "YES", the processing returns to step 192. Therefore, the processes of steps 192 to 208 are repeatedly executed until the value i becomes equal to "5".

When the value becomes equal to "5", the judgement result of step 208 turns to "NO", so that the processing proceeds to step 210. These processes of steps described heretofore are executed in order to cancel the preset group and make a new group.

For example, when No. 0 and No. 2 switches CHNS belong to the same group, the data (00101) is set to both of the registers GRP(0) and GRP(2). Then, the record mode is set to No. 0 and No. 1 switches CHNS so that the data (00011) is stored in the register REC. In case of i=0, when the processing proceeds to step 192, REC0=1 so that its judgement result turns to "YES". In addition, GRP(0)O=1 in step 196 so that its judgement result turns to "YES". Therefore, the value "0" is set to the register GRP(0) in step 198. Thereafter, the processing proceeds to step 196 in case of j=2, GRP(2)O=1 so that the judgement result of step 196 turns to "YES". Then, the value "0" is set to the register GRP(2) in step 198. As a result, the group consisting of No. 0 and No. 2 switches CHNS is canceled.

Thereafter, when the value j becomes equal to "5", the data (00011) stored in the register REC is set to the register GRP(0) in step 204. Then, when the processing proceeds to step 192 in case of i=1, REC1=1 so that its judgement result turns to "YES". In next step 194, the value j becomes equal to "1". In step 196, in case of GRP(1)1=0, its judgement result turns to "NO", so that the value "2" is set as the value j in step 200. Then, the processing returns to step 196. Since the value "0" is previously set to the register GRP(2)1 in step 196, the judgement result of step 196 turns to "NO".

Thereafter, when the value j becomes equal to "5", the data (00011) stored in the register REC is set to the register GRP(1) in step 204. Then, when the value i becomes equal to "5", the processing proceeds from step 208 to 210. As a result, the group consisting of No. 0 and No. 2 switches CHNS is canceled and a new group consisting of No. 0 and No. 1 switches CHNS is made.

The processes of steps 210 etc. are for writing the data indicative of jump destination and storing stop position into the storing area MMR within the auto-play memory 22 in order to start the running in the record mode.

In step 210, value "4" is set to the value i, while the data $F_H$ (storing stop position information) is entered into the register GT. Similar to foregoing step 192, it is judged whether or not RECi=1 in step 212. If the this judgement result of step 212 is "YES", the processing proceeds to 214.

In step 214, data $EO_H$+GT are written into both of the of the storing areas MMR((i+1)×1000+999) and MMR((i+1)×1000+998) (which are the last two storing blocks). In step 216, the value i is set to the register GT.

After completing the process of step 216 or if the judgement result of step 212 is "NO", the processing proceeds to step 218 wherein the value i is decremented by one. In next step 220, it is judged whether the value i is smaller than "0" or not. If the judgement result of step 220 is "NO", the processing returns to step 212, whereby the processes of steps 212 to 220 are repeatedly executed until the value i becomes equal to −1.

When the value i becomes equal to −1, the judgement result of step 220 turns to "YES" so that the processing returns to the start/stop subroutine shown in FIGS. 11A and 11B.

For example, when the data (000011) is stored in the register REC and then the processing proceeds to step 212 in the state of i=4, REC4=0 so that the judgement result of step 212 turns to "NO". Then, the processing proceeds to step 218 wherein the value i is changed to "3". Thereafter, when the processing returns to step 212 via step 220, the judgement result of step 212 is "NO". Similarly, the judgement result of step 212 is still "NO" in the state of i=2.

However, when the value i is changed to "1" in step 218 and then the processing returns to step 212, REC1=1 so that the judgement result of step 212 turns to "YES". Thus, the data $EO_H+F_H$ is written into both of the storing areas MMR(2999) and MMR(2998). In step 216, the value "1" is set to the register GT. Thereafter, the value i is set equal to "0" in next step 218.

Afterward, when the processing returns to step 212 in the state of i=0, REC0=1 so that the judgement result of step 212 turns to "YES". Thus, data $EO_H$+1 (i.e., data which designates the jumping to the storing block B1) is written into both of the storing areas MMR(1999) and MMR(1998) in step 214. Then, the value i is changed to "−1" in step 218, so that the judgement result of step 220 turns to "YES", whereby the processing returns to the start/stop subroutine shown in FIGS. 11A and 11B. As a result, two storing blocks B0 and B1 are connected together so that these two storing blocks will substantially work as one storing block.

(10) CHNS-On Subroutine (FIGS. 13A and 13B)

In the CHNS-on subroutine shown in FIGS. 13A and 13B, first step 230 judges whether RUN=1 or not. If the judgement result of step 230 is "YES", the processing proceeds to step 231 wherein the CPU 16 executes the running CHNS-on subroutine which will be described later in conjunction with FIG. 14. Thereafter, the processing returns to the main routine shown in FIG. 7. In other words, the following processes will not be carried out in the running state.

If the judgement result of step 230 is "NO", it is found that RUN=0 or RUN=−1. Therefore, the processing proceeds to step 232 wherein it is judged whether the record mode designating switch RECS is simultaneously turned on with other switches or not. If the judgement result of step 232 is "YES", the processing proceeds to next step 234 (shown in FIG. 13B).

In step 234, it is judged whether the value "1" is set to No. i bit RECi of the register REC (i.e., the record mode is set to the operated No. i switch CHNS) or not. If the judgement result of step 234 is "YES", the processing returns to the main routine shown in FIG. 7. Because, the record mode has been already set so that it is unnecessary to execute the processes which will be described below.

If the judgement result of step 234 is "NO", the processing proceeds to step 236 wherein the value "1" is set to No. i bit PLYi of the register PLY (i.e., the play mode is set to the operated No. i switch CHNS) or not. If the judgement result of step 236 is "YES", the value "0" is set as the control variable j in next step 238. Then, the processing proceeds to step 240.

In step 240, it is judged whether or not the value "1" is set to No. j bit GRP(i)j of the register GRP(i) corresponding to the operated No. i switch CHNS. If the judgement result of step 240 is "YES", the value "0" is set to No. j bit PLYj of the register PLY in next step 242. Then, the processing proceeds to step 244 wherein No. j LED corresponding to the No. j bit PLYj is lighted off. As a result, the normal mode is set to No. j switch CHNS which belongs to the group including No. i switch CHNS.

After completing the process of step 244 or if the judgement result of step 240 is "NO", the value j is incremented by one in step 246. In next step 248, it is judged whether the value j is smaller than "5" or not. If the judgement result of step 248 is "YES", the processing returns to step 240. Thus, the processes of steps 240 to 248 are repeatedly executed until the value j becomes equal to "5". As a result, the normal mode is set to the switch CHNS which belongs to the group including the operated No. i switch CHNS.

When the value j becomes equal to "5", the judgement result of step 248 turns to "NO" so that the processing proceeds to step 250. In addition, when the judgement result of step 236 is "NO", the normal mode must be set to No. i switch CHNS so that the processing proceeds to step 250.

In step 250, the value "1" is set to RECi. In next step 252, the red light of No. i LED corresponding to the operated No. i switch CHNS is lighted on. As a result, the record mode is set to No. i switch CHNS. Thereafter, the processing proceeds to step 254.

In step 254, it is judged whether the value "0" is set to both of the registers PLY and REC or not. In case of RECi=1 which is set in above step 250, the judgement result of step 254 turns to "NO" so that the processing proceeds to step 256.

In step 256, the value "−1" is set to the run flag RUN so that the synchro-standby state is set. Thereafter, the processing returns to the main routine shown in FIG. 7.

If the judgement result of step 232 is "NO", it is found that No. i switch CHNS was only operated. Then, the processing proceeds to step 258 wherein it is judged whether or not PLYi=1 as similar to foregoing step 236. If the judgement result of step 258 is "YES", it is found that the play mode is set to the operated No. i switch CHNS. Then, the processing proceeds to step 260.

In step 260, the value "0" is set as the control variable j. In next step 262, as similar to foregoing step 240, it is judged whether the value "1" is set to GRP(i)j or not. If the judgement result of step 262 is "YES", the processing proceeds to step 264 wherein the value "0" is set to PLYj as similar to foregoing step 242. Thereafter, No. j LED corresponding to the bit PLYj is lighted off in step 266.

After completing the process of step 266 or if the judgement result of step 262 is "NO", the value j is incremented by one in step 268. Then, the processing proceeds to step 270 wherein it is judged whether the value j is smaller than "5" or not. If the judgement result of step 270 is "YES", the processing returns to step 262. Thus, the processes of steps 262 to 270 are repeatedly executed until the value j becomes equal to "5".

When the value becomes equal to "5", the judgement result of step 270 turns to "NO", so that the processing proceeds to step 254. As a result, the normal switch is set to all of the operated No. i switch CHNS and other switches CHNS in the same group.

In step 254, it is judged whether the value "0" is set to both of the registers PLY and REC or not. If the judgement result of step 254 is "NO", the processing returns to the main routine shown in FIG. 7 via next step 256. When the judgement result of step 254 is "YES", it is found that the normal mode has been already set to all of No. 0 to No. 4 switches CHNS. Then, the processing proceeds to step 272.

In step 272, the value "0" is set to the run flag RUN so that the stop mode is set. Thereafter, the processing returns to the main routine shown in FIG. 7.

If the judgement result of step 258 is "NO", the processing proceeds to step 274 wherein it is judged whether RECi=1 or not as similar to foregoing step 234. If the judgement result of step 274 is "YES", it is found that the record mode was set to the operated No. i switch CHNS. Then, the processing proceeds to step 276.

In step 276, the value "0" is set to the bit RECi. In next step 278, No. i LED corresponding to the bit RECi is lighted off. As a result, the normal mode is set to No. i switch CHNS. Thereafter, the processing proceeds to step 254. Thereafter, the processes of steps 254 and 272 are executed as described before.

When the judgement result of step 274 is "NO", it is found that the normal mode was set to the operated No. i switch CHNS. Then, the processing proceeds to step 280.

In step 280, the value "0" is set as the value j. In next step 282, it is judged whether or not GRP(i)j=1 or not as similar to foregoing step 240. If the judgement result of step 282 is "YES", the processing proceeds to step 284 wherein the value "1" is set to the bit PLYj as similar to foregoing step 242. Then, the processing proceeds to step 286.

In step 286, it is judged whether the value "1" is set to No. j bit RECj of the register REC or not. If the judgement result of step 286 is "YES", the value "0" is set to the bit RECj in next step 288. As a result, the record mode of No. j switch CHNS is canceled.

After completing the process of step 288 or if the judgement result of step 286 is "NO", the processing proceeds to step 290 wherein the green light is on at No. j switch CHNS corresponding to the bit RECj. As a result, the play mode is set to No. j switch CHNS.

After completing the process of step 290 or if the judgement result of step 282 is "NO", the value j is incremented by one in step 292. Then, the processing proceeds to step 294 wherein it is judged whether the value is smaller than "5" or not. If the judgement result of step 294 is "YES", the processing returns to step 282. Thus, the processes of steps 282 to 294 are repeatedly executed until the value j becomes equal to "5".

When the value j becomes equal to "5", the judgement result of step 294 must turn to "NO", and then the processing proceeds to step 254. Thereafter, the processes of steps 254, 256 and 272 are executed as described before.

Due to the processes of these steps 280 to 294, the mode of operated No. i switch CHNS is changed from the normal mode to the play mode. When the normal mode is set to other switches CHNS included in the same group of the operated No. i switch CHNS, the play mode is set to other switches CHNS. When the record mode is set to other switches, this record mode is canceled and the play mode is newly set to other switches CHNS.

For example, when No. 0 to No. 2 switches CHNS belong to the same group, the data (00111) may be written into the registers GRP(0) to GRP(2). In addition, the normal mode may be set to all of No. 0 to No. 2 switches. In this case, by turning on No. 0 switch, the processes of steps 282, 284 and 290 are executed by three times with respect to j=0 to 2. Thus, the data (000111) is set to the register PLY; green lights are lighted on at No. 0 to No. 2 LED; and the play mode is set to all of No. 0 to No. 2 switches. In such state, when the record mode is set to No. 1 and No. 2 switches so that the data (00110) is set to the register REC, the processing passes through steps 286 and 288 so that the value "0" is set to all bits of the register REC with respect to j=1 and 2. Further, the record mode is canceled and then play mode is newly set to No. 1 and No. 2 switches.

(11) Running CHNS-On Subroutine (FIG. 14)

In the running CHNS-on subroutine shown in FIG. 14, first step 370 judges whether the record mode designating switch RECS is simultaneously turned on with No. i switch CHNS or not. If the judgement result of step 370 is "YES", the processing returns to the CHNS-on subroutine shown in FIGS. 13A and 13B. In other words, when the switch RECS is simultaneously on with No. i switch CHNS, the CPU 16 does not execute the following processes.

If the judgement result of step 370 is "NO", next step 372 judges whether or not PLYi=1 or not as similar to foregoing step 236. If the judgement result of step 372 is "YES", it is found that the play mode was set. Then, in next step 374, value "2" is set to the flag FLG(i) corresponding to No. i switch CHNS in order to stop the play. Thereafter, the processing returns to the CHNS-on subroutine shown in FIGS. 13A and 13B.

On the other hand, if the judgement result of step 372 is "NO", its succeeding step 376 judges whether or not RECi=1 or not as similar to foregoing step 234. If the judgement result of step 376 is "YES", it is found that the record mode was set. Then, in next step 378, value "3" is set to the flag FLG(i) in order to stop the recording. Thereafter, the processing returns to the CHNS-on subroutine.

When the judgement result of step 376 is "NO", it is found that the normal mode was set. Then, in next step 380, the value "1" is set to the flag FLG(i) in order to start the play. Thereafter, the processing proceeds to step 382.

In step 382, it is judged whether REC=0 or not. If the judgement result of step 382 is "YES", it is proved that the record mode is set to none of the switches CHNS. Then, the processing returns to the CHNS-on subroutine.

On the other hand, if the judgement result of step 382 is "NO", it is proved that the record mode is set any one of the switches CHNS other than the operated No. i switch CHNS (i.e., the recording is carried out on the specific part).

Then, the processing proceeds to step 384 wherein data $CO_H+2^i$ (whose upper three bits are (110) but No. i bit takes value "1") is written into the address storing area MMR(PNTR) as the following operation information. Thereafter, the value of pointer PNTR is incremented by one in next step 386, and then the processing returns to the CHNS-on subroutine.

(12) Clock Interrupt Routine (FIGS. 15A and 15B)

The clock interrupt routine as shown in FIGS. 15A and 15B is started by every clock pulse within the tempo clock signal TCL.

In this clock interrupt routine, first step 300 judges whether RUN=1 or not. If the judgement result of step 300 is "NO", the processing returns to the main routine shown in FIG. 7. On the other hand, if the judgement result of step 300 is "YES", the processing proceeds to step 302.

In step 302, the value "0" is set as the control variable i. In next step 304, it is judged whether the value "0" is set to No. i pointer PNTP(i) (i.e., this pointer is not used in the play mode or the record mode is set to this pointer) or not. If the judgement result of step 304 is "NO", the processing proceeds to step 306 in order to refer to the contents of data stored in the auto-play memory 22 based on the data of pointer PNTP(i).

In step 306, it is judged whether the data of address storing area MMR(PNTP(i)) is identical to the timing indicated by the counter CLK (i.e., it is the timing of generating or muting the tone) or not. If the judgement result of step 306 is "YES", the processing proceeds to step 308 wherein the data of area MMR(PNTP(i)+1) (i.e., the key code information) is entered into the register KEY. Then, the value of pointer PNTP(i) is incremented by two in step 310.

In next step 312, the CPU16 executes the AND operation between the data of register KEY and data $7F_H$ (whose MSB takes value "0" but other bits take value "1") to thereby extract the key code from the register KEY, and then this extracted key code is set to the register KC.

In step 314, the value of MSB (i.e., value "0" or "1") is entered into the register KON. Then, the data of No. i register GRP(i) is set to the register ASS in step 316. As a result, if the data (00011) is stored in the register GRP(0), No. 0 and No. 1 channels become assignable.

Next, step 318 judges whether KON=1 (i.e., it is the key-on timing) or not. If the judgement result of step 318 is "YES", the processing proceeds to step 320 wherein the number of the channel whose musical tone is the most attenuate within the channels corresponding to the bits taking value "1" of the register ASS is entered into the register CH as similar to foregoing step 80 shown in FIG. 8. Thereafter, the processing proceeds to step 322.

In step 322, the key code information of register KEY is entered into the register KCBUF(CH) corresponding to the channel number of register CH. Then, in step 324, the key-on process is carried out on the channel corresponding to the value of register CH within the channels of tone generator 26 by the key code of register KC so that the musical tone corresponding to such key code is generated as similar to step 84 shown in FIG. 8.

Then, the processing proceeds to step 326 wherein it is judged whether the data of register MMR(PNTP(i)) is identical to data $EX_H$ (indicative of the jump mark) or not. If the judgement result of step 326 is "NO", the processing returns to step 306. On the other hand, if the judgement result of step 326 is "YES", the processing proceeds to step 328.

In step 328, the head address of jump destination is obtained in accordance with the formula $(X+1)\times 1000$ and then this head address is set to the pointer PNTP(i). Herein, "X" takes the value of lower four bits of data stored in the area MMR(PNTP(i)) (i.e., the number of storing block which is set as the jump destination). For example, in the case where the value of pointer PNTP(0) is not "0" but PNTP(1)=0 and X=1, the value 2000 is set to the pointer PNTP(0), which enables the jumping for the storing block B1. More specifically, the value of pointer PNTP(0) is used for reading the performance information of storing block B1 thereafter, but the value of another pointer PNTP(1) is not used (so that the judgement result of step 304 turns to "YES"). After completing the process of step 328, the processing returns to step 306.

Thereafter, the above-mentioned processes of steps 306 to 328 are repeatedly executed. Therefore, at the timing of counter CLK, it is possible to simultaneously generate the musical tones whose number corresponds to the number of bits taking value "1" within the register GRP(i). For example, in case of GRP(0)=(00011) as described above, it is possible to simultaneously generate two musical tones.

Meanwhile, if the judgement result of step 318 is "NO", it is found that it is the key-off timing. Then, the processing proceeds to step 330 (shown in FIG. 15B) wherein the CPU 16 searches the data equal to data ($80_H$+KC) in the register KCBUF concerning the channel corresponding to the bit having value "1" within the register ASS (i.e., the channel to which the key code of register KC has been already assigned) as similar to step 106 shown in FIG. 8.

Next, step 332 judges whether there is the data equal to the data ($80_H$+KC) or not. If the judgement result of step 332 is "YES", the processing proceeds to step 334 wherein the found number of assigned channel is entered into the register CH.

In next step 336, the value "0" is set to the MSB of register KCBUF(CH). As a result, the MSB of key code information of the register KCBUF(CH) is varied from "1" to "0". Thereafter, in step 338, the key-off process is executed on the channel corresponding to the value of register CH within the channels of tone generator 26 so that the musical tone signal whose musical tone is generating is muted.

After completing the process of step 338 or if the judgement result of step 332 is "NO", the processing proceeds to step 326 (shown in FIG. 15A) so that the succeeding processes which start from step 326 will be carried out as described before.

The above-mentioned processes are executed when the judgement result of step 306 is "YES". On the contrary, if the judgement result of step 306 is "NO", the processing proceeds to step 340.

In step 340, it is judged whether the data $FF_H$ (i.e., the end information) is stored in the area MMR(PNTP(i)) or not. If the judgement result of step 340 is "NO", the processing proceeds to step 341.

In step 341, it is judged whether the upper three bits of the data stored in the area MMR(PNTP(i)) is identical to (110) (i.e., this data indicates the following operation information) or not. If the judgement result of step 341 is "NO", the processing proceeds to step 342. On the other hand, if this judgement result is "YES", the processing proceeds to step 343.

In step 343, the CPU 16 executes the following flag set subroutine which will be described later in conjunction with FIG. 16. Then, the processing returns to step 326, whereby the processes which start from step 326 are carried out as described before.

If the judgement result of step 341 is "NO", the processing proceeds to step 342 as described above. Similarly, even when this judgement result is "YES", the processing proceeds to step 342.

In step 342, the control variable i is incremented by one. Then, the processing proceeds to step 344 wherein it is judged whether the control variable i is smaller than "5" or not. If the judgement result of step 344 is "YES", the processing returns to step 304, whereby the processes of steps 304 to 344 are repeatedly executed until the control variable i becomes equal to "5". As a result, if the value "0" is not set to the pointers PNTP(0) to PNTP(4) at all, it becomes possible to automatically perform five parts in accordance with the performance information of No. 0 to No. 4 parts stored in the storing blocks B0 to B4. In this example, if it is judged that the key-on timing information of each of the storing blocks B0 to B4 is identical to the timing of counter CLK in step 306, the five musical tones are simultaneously generated by this timing.

When the control variable i becomes equal to "5", the judgement result of step 344 turns to "NO". Then, the processing proceeds to step 346 wherein the value of counter CLK is incremented by one.

In next step 348, it is judged whether the value of counter CLK is equal to "96" (i.e., it is the timing of bar end) or not. If the judgement result of step 348 is "NO", the processing returns to the main routine shown in FIG. 7.

If the judgement result of step 348 is "YES", the processing proceeds to step 350 wherein the value "0" is set to the counter CLK. Then, in step 351, the CPU 16 executes the following play check subroutine which will be described later in conjunction with FIG. 17. Thereafter, the value "0" is set to the control variable i in step 352, and then the processing proceeds to step 354.

In step 354, it is judged whether the value "0" is set to the pointer PNTP(i) or not. If the judgement result of step 354 is "NO", the value of pointer PNTP(i) is incremented by one in step 356. This increment is done in order to jump the bar line in the play mode.

After completing the process of step 356 or if the judgement result of step 354 is "YES", the control variable i is incremented by one in step 358. Then, the processing proceeds to step 360 wherein it is judged whether the control variable i is smaller than "5" or not. If the judgement result of step 360 is "YES", the processing returns to step 354. Thereafter, the processes of steps 354 to 360 are repeatedly executed until the control variable i becomes equal to "5".

When the control variable i becomes equal to "5", the judgement result of step 360 turns to "NO" so that the processing proceeds to step 362. In step 362, it is judged whether REC=0 (i.e., the play mode is set) or not. If the judgement result of step 362 is "YES", the processing returns to the main routine shown in FIG. 7.

If the judgement result of step 362 is "NO", it is found that the record mode is set. Then, the processing proceeds to step 364 wherein data $80_H$ (i.e., bar line information) is written into the area MMR(PNTR). In next step 366, the value of pointer PNTR is incremented by one.

In succeeding step 368, the CPU 16 executes the jump subroutine shown in FIG. 10. Thereafter, the processing returns to the main routine shown in FIG. 7.

By the above-mentioned processes, it is possible to carry out the automatic performance or performance recording by each storing block based on the value of counter CLK. In this case, plural storing blocks which are interconnected together (i.e., which belong to the same group) are treated as one storing block.

When the judgement result of step 340 is "YES", the automatic performance of one part is completed. In step 370, the value "0" is set to No. i bit PLYi of the register PLY.

In next step 372, it is judged whether PLY=0 (i.e., there is no part for the play mode) or not. If the judgement result of step 372 is "NO", the processing proceeds to step 342 in order to continue the automatic performance of remaining parts. On the other hand, if the judgement result of step 372 is "YES", the processing proceeds to step 374.

In step 374, it is judged whether REC=0 (i.e., there is not part for the record mode) or not. If the judgement result of step 374 is "NO", the processing proceeds to step 342 in order to continue the performance recording of the part for the record mode. On the other hand, if the judgement result of step 374 is "YES", there is no part for the play mode or record mode. In step 376, the value "0" is set to the run flag RUN, and then the processing returns to the main routine shown in FIG. 7.

(13) Following Flag Subroutine (FIG. 16)

In first step 390 of the following flag set subroutine shown in FIG. 16, the AND operation is executed between the following operation information read from the area MMR(PNTP(i)) and data $1F_H$, and its operation result (i.e., data of lower five bits of the following operation information) is entered into the register FLGCHK. In next step 392, the value "0" is set as the control variable j.

Next, step 394 judges whether the value "1" is set to No. j bit FLGCHKj of the register FLGCHK (i.e., there is a record in which No. j switch CHNS is operated on) or not. If the judgement result of step 394 is "YES", the processing proceeds to step 396 wherein it is judged whether PLYj=1 or not. If the judgement result of step 396 is "YES", it is found that the play mode is set to the part corresponding to No. j switch CHNS. In next step 398, the value "2" is set to the flag FLG(i) in order to stop the play. In this case, the following operation information read from the memory 22 is used as the play stop designating information.

If the judgement result of step 396 is "NO", the play mode is not set to the part corresponding to No. j switch CHNS. In next step 400, the value "1" is set to the flag FLG(i) in order to start the play. In this case, the following operation information read from the memory 22 is used as the play start designating information.

The processes of steps 398 and 400 correspond to the processes of foregoing steps 374 and 380 shown in FIG. 14. Therefore, by using the information stored in the memory 22 but without operating the switch CHNS, it is possible to control the play stop or play start which are identical to those in the case where the switch CHNS is on.

After completing the process of step 398 or 400, or if the judgement result of step 394 is "NO", the processing proceeds to step 402 wherein the control variable j is incremented by one.

In step 404, it is judged whether the control variable j is smaller than "5" or not. If the judgement result of step 404 is "YES", the processing returns to step 394. Thereafter, the processes of steps 394 to 404 are repeatedly executed until the control variable j becomes equal to "5".

When the control variable j becomes equal to "5", the judgement result of step 404 turns to "NO", so that the processing returns to the clock interrupt routine shown in FIGS. 15A and 15B.

(14) Following Play Check Subroutine (FIGS. 17A and 17B)

In first step 410 of the following play check subroutine shown in FIGS. 17A and 17B, the value "0" is set as the control variable i.

In next step 412, it is judged whether FLG(i)=0 (i.e., there is no following operation which is the actual on-operation or its recording) or not. If the judgement result of step 412 is "YES", the control variable i is incremented by one in step 414. Then, the processing proceeds to step 416 wherein it is judged whether the control variable i is smaller than "5" or not. If the judgement result of step 416 is "YES", the processing returns to step 412. Thereafter, the processes of steps 412 to 416 are repeatedly executed until the control variable i becomes equal to "5".

When the control variable i becomes equal to "5", the judgement result of step 416 turns to "NO", so that the processing returns to the clock interrupt routine shown in FIGS. 15A and 15B.

When the judgement result of step 412 turns to "NO", it is found that the following operation is executed. Then, the processing proceeds to step 418 which judges the value of flag FLG(i). If it is judged that FLG(i)=1, the processing proceeds to step 420 in order to start the play.

In step 420, the value "0" is set as the control variable j. Then, processes of steps 422, 424, 426, 428 and 430 are sequentially executed as similar to foregoing steps 282, 284, 290, 292 and 294. As a result, in the case where No. i switch CHNS does not belong to the group to which other switches CHNS belong, the play mode is set only to No. i switch CHNS so that the green light is on in its corresponding LED. On the other hand, in the case where No. i switch CHNS and other switches CHNS all belong to the same group, the play mode is set to all of the switches CHNS in such group so that the green lights are on in its corresponding LED.

Next, the value "0" is set as the control variable i in step 432. In succeeding step 434, it is judged whether GRP(i)j=1 or not as similar to foregoing step 422. If the judgement result of step 434 is "NO", the control variable j is incremented by one in step 436. Then, step 438 judges whether the control variable j is smaller than "5" or not. If the judgement result of step 438 is "YES", the processing returns to step 434. Thereafter, the processes of steps 434 to 438 are repeatedly executed until the control variable j becomes equal to "5".

When the judgement result of step 434 turns to "YES", the processing proceeds to step 440 wherein the head address is calculated in accordance with the formula $(j+1)\times 1000$ and then the calculated head address is set to No. j pointer PNTPj. As a result, in the case where No. i switch CHNS does not belong to the group to which other switches CHNS belong, the head address is set to the pointer PNTPi corresponding to No. i switch CHNS. In another case where No. i switch CHNS and other switches CHNS all belong to the same group, the head address is set to the pointer PNTPj corresponding to the switch CHNS whose number j is the smallest within the switches of such group.

After completing the process of step 440 or if the control variable j becomes equal to "5" in step 438, the flag FLG(i) is reset so that its value becomes "0" in step 442, and then the processing returns to step 414. Thus, the processes which start from step 414 are repeatedly executed as described before.

For example, in the case where FLG(1)=1 and GRP(1)=(00010), the data (00010) is set to the register PLY and green light of No. 1 LED is on (so that the play mode is set to No. 1 switch CHNS) by the steps 424 and 426, and the value 2000 is set as the head address of pointer PNTP1 by the step 440. In the case where data (01110) is set to all of the registers GRP(1) to GRP(3) (which means that all of No. 1 to No. 3 switches CHNS belong to the same group), the data (01110) is set to the register PLY (i.e., the play mode is set to all of No. 1 to No. 3 switches CHNS); the head address 2000 is set to the pointer PNTP1; but the head address is not set to the pointers PNTP2 and PNTP3.

Thereafter, the reproduction (i.e., automatic performance) is started with respect to the part to which the play mode is set.

When step 418 judges that FLG(i)=2, the processing proceeds to step 444 in order to stop the play.

In step 444, the value "0" is set as the control variable j. The next step 446 judges whether or not GRP(i)j=1 or not as similar to foregoing step 422. If the judgement result of step 446 is "YES", the processing proceeds to step 448.

In step 448, the value "0" is set to the MSB of register KCBUF(j). Then, the key-off process is executed on the channel corresponding to the control variable j within the tone generator 26. After the value "0" is set to No. j bit PLYj of the register PLY in step 452, No. j LED is lighted off in step 454. Further, No. j pointer PNTPj is reset so that its value is varied to "0" in step 456.

After completing the process of step 456 or if the judgement result of step 446 is "NO", the processing proceeds to step 458 wherein the control variable j is incremented by one. Then, next step 460 judges whether the control variable j is smaller than "5" or not. If the judgement result of step 460 is "YES", the processing returns to step 446. Thereafter, the processes of steps 446 to 460 are repeatedly executed until the control variable j becomes equal to "5".

Therefore, in the case where No. i switch CHNS does not belong to the group to which other switches CHNS belong, the tone generation at the channel corresponding to No. i switch CHNS is stopped and the play mode of No. i switch CHNS is canceled. In the case where No. i switch CHNS and other switches CHNS all belong to the same group, the tone generation in the channels corresponding to all switches CHNS which belong to such group is stopped and the play modes of all switches CHNS are canceled.

When the control variable j becomes equal to "5", the judgement result of step 460 turns to "NO", so that the processing proceeds to step 462 wherein it is judged whether the value "0" is set to both of the registers PLY and REC or not. If the judgement result of step 462 is "NO", the processing proceeds to step 442. Thereafter, the processes which start from step 442 will be repeatedly executed as described before.

If the judgement result of step 462 is "YES", the value "0" is set to the run flag RUN so that the stop state is set in step 464. Then, the processing returns to the clock interrupt routine shown in FIG. 15.

When step 418 judges that FLG(i)=3, the CPU 16 executes the processes which start from step 466 in order to stop the recording.

In step 466, the value "0" is set as the control variable j. Next step 468 judges whether or not GRP(i)j=1 or not as similar to step 422. If the judgement result of step 468 is "YES", the processing proceeds to step 470.

In step 470, the value "0" is set to the MSB of the register KCBUF(j). Then, the key-off process is executed on the channel corresponding to the control variable j within the tone generator 26 in step 472. After the value "0" is set to No. j bit RECj of the register REC in step 474, No. j LED is lighted off in step 476.

In next step 478, the value of counter CLK is written into the area MMR(PNTR) as the timing information concerning the key-off. In step 480, the data of register KCBUF(j) is written into the area MMR(PNTR+1) as the key code information concerning the key-off. Thereafter, the processing proceeds to step 482.

In step 482, the value of pointer PNTR is incremented by two. Then, the processing proceeds to step 484 wherein the foregoing jump subroutine as shown in FIG. 10 is executed.

After completing the process of step 484 or if the judgement result of step 468 is "NO", the processing proceeds to step 488 wherein the control variable j is incremented by one. In next step 488, it is judged whether the control variable j is smaller than "5" or not. If the judgement result of step 488 is "YES", the processing returns to step 468. Thereafter, the processes of steps 468 to 488 are repeatedly executed until the control variable j becomes equal to "5".

Therefore, in the case where No. i switch CHNS does not belong to the group to which other switches CHNS belong, the tone generation in the channel corresponding to No. i switch CHNS is stopped; the record mode of No. i switch CHNS is canceled; and the key-off information corresponding to No. i switch CHNS is written into the memory 22 with respect to the canceled part. On the other hand, in the case where No. i switch CHNS and other switches CHNS all belong to the same group, the tone generation in the channels corresponding to all switches CHNS is stopped; the record modes of all switches CHNS which belong to such group are canceled; and the key-off information corresponding to all switches CHNS which belong to the group is written into the memory 22 with respect to the canceled part.

When the control variable j becomes equal to "5", the judgement result of step 488 turns to "NO", so that the processing proceeds to step 490 wherein the data $FF_H$ (i.e., end information) is written into the area MMR(PNTR). Then, the processing proceeds to step 462. Thereafter, the CPU 16 executes the processes which start from step 462.

Therefore, when plural switches CHNS belong to the same group, the following play check subroutine as shown in FIGS. 17A and 17B controls the transition for the play mode, cancellation of play mode or cancellation of record mode by each group. The following operation may be done on only one of plural switches CHNS in the above-mentioned processes. Therefore, the manual operation can be simplified.

(15) Operation Example Of Recording & Reproduction (FIG. 18)

According to the present embodiment, it is possible to carry out the following operations (A) to (C).

(A) The reproduction is started from first bar of a part a based on the operation of first switch CHNS1, and third switch CHNS3 corresponding to a part b is on in the middle of third bar to be reproduced. Thus, in response to the on-operation of the third switch CHNS3, the value "1" is set to the flag FLG(3) in step 380 shown in FIG. 14. Due to the processes which start from step 420, the reproduction of part b can be started in synchronism with the head timing of fourth bar of part a. In this case, by pre-recording the part b from the head position of fourth bar of part a, the reproductin of part b can be started from the fourth bar of the part b. Thus, the reproduction of part b can be coincided with the progress of part a.

In the example (A), the part b is recorded from its first bar; the part b is reproduced simultaneously with the part a; and the switch CHNS3 is one by the timing as shown in FIG. 18(A). In response to the on-operation of the switch CHNS3, the value "2" is set to the flag FLG(3). Therefore, due to the processes which start from step 444, the reproduction of the part b is stopped at the end of third bar. In this case, if the first switch CHNS1 is used instead of the third switch CHNS3, the reproduction of part a is stopped at the end of third bar.

(B) The recording of part a is started from the first bar based on the operations of second switch CHNS2 and switch RECS, and then fourth switch CHNS4 corresponding to the part b is on in the middle of second bar. Thus, in response to the on-operation of fourth switch CHNS4, the value "1" is set to the flag FLG(4) in step 380 shown in FIG. 14. Therefore, due to the processes which start from step 420 shown in FIG. 17A, the reproduction of part b can be executed in synchronism with the head timing of third bar of the part a. By pre-recording the part b at the head timing of third bar, the reproduction of part b can be started from third bar. In addition, the reproduction of part b can be synchronized with the progress of the part a.

In the example (B), the part b is recorded from the first bar; the reproduction of part b is simultaneously started with the part a; and then the fourth switch CHNS4 is on. Thus, the reproduction of part b can be stopped at the end of second bar. In this case, when the second switch CHNS2 is on instead of the fourth switch CHNS4, the value "3" is set to the flag FLG(2) in the step 378 shown in FIG. 14. Therefore, due to the processes which start from step 466 shown in FIGS. 17A and 17B, the recording of part a is stopped at the end of second bar.

Incidentally, in the example (B), when the fourth switch CHNS4 is on in order to start the reproduction, the following operation information (11010000) is written into the memory 22 in response to the on-operation of switch CHNS in step 384 shown in FIG. 14.

(C) The reproduction of part a is started from the first bar based on the operation of switch CHNS2 in the above-mentioned example (B). In the case where the reproduction of part b (concerning the switch CHNS4 in the example (B)) is not started simultaneously with the reproduction of part a, the value "1" is set to the flag FLG(4) in step 400 shown in FIG. 16. Therefore, due to the processes which start from step 420 shown in FIG. 17A, the reproduction of part b is started simultaneously with the third bar of the part a. If the part b is recorded from the head timing of third bar, the reproduction of part b can be started from the third bar. Thus, the reproduction of part b can be coincided with that of part a.

In the example (C), when the reproduction of part b is simultaneously started with that of part a, the value "2" is set to the flag FLG(4) in step 398 shown in FIG. 16. Thus, due to the processes which start from step 444, the reproduction of part b is stopped at the end of second bar.

As described above, by using the following operation information stored in the memory 22, the reproduction can be started or stopped without operation the switch CHNS4. Therefore, this embodiment is quite useful.

(16) Modified Examples

This invention may be practiced or embodied in still other ways without departing from the spirit or essential character thereof. For example, the following modifications can be embodied.

(a) Since the present embodiment provides only one keyboard, it is impossible to record the performances of one part and another part in parallel in the record mode. However, by using plural keyboards or by dividing the single keyboard into plural key areas, such parallel recording can be carried out. In such parallel recording, each part can be independently started. In the case where the recording of another part is designated during the recording of one part, such designation information can be included within the performance information of one part as the reproduction designating information. This designation information can be used for automatically starting the reproduction of another part in the reproduction period.

(b) The timing information of auto-play memory 22 can be relative time information from the previous event. In such case, since the bar line information is recorded when the time passed from the preceding event exceeds over the time corresponding to one bar, the memory capacity can be reduced.

(c) The number of storing blocks in the memory 22 and the number of tone-generation channels to be used within the tone generator 26 are not limited to those described in the present embodiment.

(d) It is possible to designate the channel number in the recording and the part in the reproduction by respective switches.

Therefore, the preferred embodiment described herein is illustrative and not restrictive, the scope of the invention being indicated by the appended claims and all variations which come within the meaning of the claims are intended to be embraced therein.

What is claimed is:

1. An automatic performance apparatus comprising:

(a) memory means for storing performance information indicative of plural parts of a desirable musical tune, said plural parts including a melody part, a chord part or a bass part;

(b) designating means for independently designating reproduction of each part;

(c) first detecting means for outputting a first detection signal when it is detected that reproduction of a first part is designated and then reproduction of a second part is designated;

(d) means for generating a tempo clock signal;

(e) second detecting means for detecting the end of a bar in said tune to thereby generate a second detection signal based on said tempo clock signal; and (f) automatic performance means, for sequentially reading first performance information corresponding to said first part based on said tempo clock signal so that automatic performance of said first musical part will be played when the reproduction of said first part is designated, and for sequentially reading second performance information concerning said second part based on said tempo clock signal from a timing synchronized with said second detection signal which is generated after said first detection signal so that automatic performance of said second part will be played in parallel with said first part.

2. An automatic performance apparatus comprising:

(a) tone pitch designating means for designating a tone pitch, said tone pitch designating means generating tone pitch information every time said tone pitch is designated;

(b) memory means for storing performance information of plural parts of a desirable musical tune, said plural parts including a melody part, a chord part or a bass part;

(c) designating means for independently designating recording or reproduction of each part;

(d) means for generating a tempo clock signal;

(e) writing means for writing tone pitch information and timing information based on said tempo clock signal into said memory means as said performance information of the part to be designated at every time when said tone pitch designating means generates said tone pitch information for the part designated by said designating means;

(f) first detecting means for outputting a first detection signal when it is detected that recording of a first part is designated and then reproduction of a second part is designated;

(g) second detecting means for detecting the end of a bar in said tune to thereby generate a second detection signal based on said tempo clock signal; and (h) automatic performance means for sequentially reading performance information corresponding to said second part based on said tempo clock signal from a timing synchronized with said second detection signal which is generated after said first detection signal so that automatic performance of said second part will be played in parallel with said first part.

3. An automatic performance apparatus according to claim 2 wherein said writing means writes reproduction designating information concerning said second part into said memory means in response to said first detection signal so as to form a portion of the performance information of said first part.

4. An automatic performance apparatus comprising:

(a) memory means for storing performance information of plural parts, said plural parts including a melody part, a chord part or a bass part, of a desirable musical tune, said performance information of a first part including reproduction designating information concerning another part of said desirable tune;

(b) designating means capable of independently designating reproduction of each part;

(c) means for generating a tempo clock signal;

(d) detecting means for detecting the end of a bar in said desirable tune based on said tempo clock signal to thereby generate a detection signal; and (e) automatic performance means for sequentially reading the performance information corresponding to said first part based on said tempo clock signal so that automatic performance of said first part will be played and said automatic performance means also detecting said reproduction designating information in accordance with the reading of the performance information concerning said first part when said designating means designated the reproduction of said first part, and for sequentially reading the performance information concerning said another part based on said tempo clock signal from a timing synchronized with said detection signal which is generated from said detecting means after said reproduction designating information is detected so that automatic performance of said another part will be played in parallel with said first part.

5. An automatic performance apparatus comprising:

(a) memory means for storing performance information indicative of plural parts to be performed in parallel;

(b) designating means for designating one of said plural parts to be performed;

(c) timing adjusting means for adjusting a performance start timing of a first part to a bar corresponding to the timing of a second part within said plural parts; and (d) tone generation means for simultaneously generating tones of said first part with tones of said second part in an overlapping manner under control of said timing adjusting means.

* * * * *